US009200792B2

(12) United States Patent
Sharrah et al.

(10) Patent No.: US 9,200,792 B2
(45) Date of Patent: Dec. 1, 2015

(54) PORTABLE LIGHT HAVING A HEAT DISSIPATER WITH AN INTEGRAL COOLING DEVICE

(75) Inventors: Raymond L. Sharrah, Collegeville, PA (US); Peter J. Ziegenfuss, Sellersville, PA (US)

(73) Assignee: Streamlight, Inc., Eagleville, PA (US)

( * ) Notice: Subject to any disclaimer, the term of this patent is extended or adjusted under 35 U.S.C. 154(b) by 1301 days.

(21) Appl. No.: 12/948,285

(22) Filed: Nov. 17, 2010

(65) Prior Publication Data

US 2011/0121727 A1 May 26, 2011

Related U.S. Application Data

(60) Provisional application No. 61/264,058, filed on Nov. 24, 2009.

(51) Int. Cl.
*F21V 29/02* (2006.01)
*F21L 4/00* (2006.01)
(Continued)

(52) U.S. Cl.
CPC . *F21V 29/02* (2013.01); *F21L 4/00* (2013.01); *F21V 29/71* (2015.01); *F21V 29/74* (2015.01); *F21Y 2101/02* (2013.01)

(58) Field of Classification Search
CPC ... F21V 21/084; F21V 29/02; F21Y 2101/02; F21Y 2103/003; F21Y 2113/005; G02B 6/0008; G02B 6/4298; G03B 29/00; F21L 4/00; F21S 4/008; A61B 18/18; A61B 17/320068; A61B 18/1492; A61N 5/00; A61M 5/1723; A61M 5/172; B01L 3/502707
USPC ..... 362/373, 158, 477, 183, 307, 235, 345, 362/208, 294, 206, 188, 202, 203, 119, 205, 362/396, 390, 485, 236, 198, 194, 800, 362/249.04, 218, 555, 362, 157, 184, 219, 362/225, 227, 231, 23.07, 23.19, 311.02; 313/44–46; 703/6; 716/108; 600/178, 600/245, 199, 249; 606/30; 607/88; 222/394, 395; 1/171.3; 345/905
See application file for complete search history.

(56) References Cited

U.S. PATENT DOCUMENTS 4,313,272 A 2/1982 Matthews
4,531,178 A 7/1985 Uke
(Continued)

FOREIGN PATENT DOCUMENTS

WO 2009/071111 11/2009

OTHER PUBLICATIONS

Papova N. et al., "Fabrication and Thermal Performance of a Thin Flat Heat Pipe With Innovative Sintered Copper Wick Structure", IEEE, © 2006, pp. 791-796.
(Continued)

*Primary Examiner* — Stephen F Husar
*Assistant Examiner* — Danielle Allen
(74) *Attorney, Agent, or Firm* — Clement A. Berard, Esq.; Dann, Dorfman, Herrell & Skillman, PC

(57) ABSTRACT

A portable light or device or heat dissipater may comprise a heat sink for having a light source or other heat generating element thermally coupled thereto, and having a plurality of walls extending from a side thereof for defining a cavity and plural passages, a fluid mover in the cavity of the heat sink for selectively causing a fluid to move through the cavity and the plural passages, and a light source or other heat generating element adjacent to and thermally coupled to the heat sink. The heat dissipater may be connected to a housing in various configurations.

20 Claims, 9 Drawing Sheets

(51) Int. Cl.

| | |
|---|---|
| ***F21V 29/71*** | (2015.01) |
| ***F21V 29/74*** | (2015.01) |
| *F21Y 101/02* | (2006.01) |

(56) References Cited

U.S. PATENT DOCUMENTS

| | | | | |
|---|---|---|---|---|
| 4,577,263 | A * | 3/1986 | Maglica | 362/187 |
| 4,683,523 | A | 7/1987 | Olsson et al. | |
| 4,729,076 | A | 3/1988 | Masami et al. | |
| 4,885,668 | A | 12/1989 | Maglica et al. | |
| 5,029,335 | A | 7/1991 | Fisher et al. | |
| 5,309,337 | A | 5/1994 | Groben | |
| 5,404,281 | A | 4/1995 | Parker | |
| 5,409,055 | A | 4/1995 | Tanaka et al. | |
| 5,432,689 | A | 7/1995 | Sharrah et al. | |
| 5,463,541 | A | 10/1995 | Greene | |
| 5,486,432 | A | 1/1996 | Sharrah et al. | |
| 5,504,650 | A * | 4/1996 | Katsui et al. | 361/697 |
| 5,513,070 | A | 4/1996 | Xie et al. | |
| 5,567,036 | A | 10/1996 | Theobald et al. | |
| 5,678,921 | A | 10/1997 | Kish et al. | |
| 5,765,938 | A * | 6/1998 | Rousso et al. | 362/198 |
| 5,785,418 | A | 7/1998 | Hochstein | |
| 5,806,965 | A | 9/1998 | Deese | |
| 5,821,695 | A | 10/1998 | Vilanilam et al. | |
| 5,856,911 | A | 1/1999 | Riley | |
| 5,871,272 | A | 2/1999 | Sharrah et al. | |
| 5,971,562 | A * | 10/1999 | Yang | 362/184 |
| 6,055,157 | A | 4/2000 | Bartilson | |
| 6,118,654 | A | 9/2000 | Bhatia | |
| 6,411,512 | B1 | 6/2002 | Mankaruse et al. | |
| 6,585,391 | B1 | 7/2003 | Koch et al. | |
| 6,633,152 | B2 | 10/2003 | Sharrah et al. | |
| 6,819,505 | B1 | 11/2004 | Cassarly et al. | |
| 6,827,468 | B2 | 12/2004 | Galli | |
| 6,942,365 | B2 | 9/2005 | Galli | |
| 6,964,877 | B2 | 11/2005 | Chen et al. | |
| 6,966,677 | B2 | 11/2005 | Galli | |
| 6,974,234 | B2 | 12/2005 | Galli | |
| 7,008,084 | B2 | 3/2006 | Galli | |
| 7,014,335 | B2 | 3/2006 | Probst et al. | |
| 7,055,989 | B2 | 6/2006 | Galli | |
| 7,083,305 | B2 | 8/2006 | Galli | |
| 7,095,110 | B2 | 8/2006 | Arik et al. | |
| 7,153,004 | B2 * | 12/2006 | Galli | 362/373 |
| 7,204,615 | B2 | 4/2007 | Arik et al. | |
| 7,220,013 | B2 | 5/2007 | Sharrah et al. | |
| 7,344,279 | B2 | 3/2008 | Mueller et al. | |
| 7,357,534 | B2 | 4/2008 | Snyder | |
| 7,422,053 | B2 | 9/2008 | Siu | |
| 7,543,961 | B2 | 6/2009 | Arik et al. | |
| 7,556,406 | B2 | 7/2009 | Petroski et al. | |
| 7,606,029 | B2 | 10/2009 | Mahalingam et al. | |
| 7,607,470 | B2 | 10/2009 | Glezer et al. | |
| 7,646,973 | B2 | 1/2010 | Howard et al. | |
| 7,760,499 | B1 | 7/2010 | Darbin et al. | |
| 7,768,779 | B2 | 8/2010 | Heffington et al. | |
| 7,784,972 | B2 | 8/2010 | Heffington et al. | |
| 7,819,556 | B2 | 10/2010 | Heffington et al. | |
| 7,883,243 | B2 | 2/2011 | Snyder | |
| 2001/0046652 | A1 * | 11/2001 | Ostler et al. | 433/29 |
| 2004/0054386 | A1 | 3/2004 | Martin et al. | |
| 2004/0188696 | A1 | 9/2004 | Hsing Chen et al. | |
| 2005/0017366 | A1 | 1/2005 | Galli | |
| 2005/0024864 | A1 | 2/2005 | Galli | |
| 2005/0041428 | A1 | 2/2005 | Zhang | |
| 2005/0047085 | A1 | 3/2005 | Mankaruse et al. | |
| 2005/0057187 | A1 | 3/2005 | Catalano | |
| 2005/0083686 | A1 | 4/2005 | Yatsuda et al. | |
| 2005/0099804 | A1 | 5/2005 | Sharrah | |
| 2005/0122713 | A1 | 6/2005 | Hutchins | |
| 2005/0128741 | A1 | 6/2005 | Matthews et al. | |
| 2005/0135090 | A1 | 6/2005 | Sharrah et al. | |
| 2005/0161684 | A1 | 7/2005 | Galli | |
| 2005/0161692 | A1 | 7/2005 | Galli | |
| 2005/0168985 | A1 | 8/2005 | Chen | |
| 2005/0201100 | A1 | 9/2005 | Cassarly et al. | |
| 2005/0243558 | A1 | 11/2005 | Van Duyn | |
| 2006/0013000 | A1 | 1/2006 | Coushaine et al. | |
| 2006/0039139 | A1 | 2/2006 | Maglica et al. | |
| 2006/0067077 | A1 | 3/2006 | Kumthampinij et al. | |
| 2006/0098439 | A1 | 5/2006 | Chen | |
| 2006/0109655 | A1 | 5/2006 | Martin | |
| 2006/0109661 | A1 | 5/2006 | Coushaine et al. | |
| 2006/0145180 | A1 | 7/2006 | Galli | |
| 2007/0236920 | A1 | 10/2007 | Snyder | |
| 2007/0253194 | A1 | 11/2007 | Sharrah et al. | |
| 2008/0018256 | A1 | 1/2008 | Snyder | |
| 2009/0001372 | A1 | 1/2009 | Arik et al. | |
| 2009/0135604 | A1 | 5/2009 | Chen | |
| 2009/0237933 | A1 * | 9/2009 | Liu | 362/249.02 |

OTHER PUBLICATIONS

Girish Upadhya, et al., "Closed-Loop Cooling Technologies for Microprocessors", © 2003 IEEE, IEDM 03-775-778, pp. 32.4.1-32.4.4, (4 pages).

Thang Nguyen et al., "Advanced Cooling System Using Miniature Heat Pipes in Mobile PC", 1998 InterSociety Conference on Thermal Phenomena, © 1998 IEEE, pp. 507-511.

H. Xie et al., "The Use of Heat Pipes in the Cooling of Portables with High Power Packages", © 1995 IEEE, pp. 906-913.

M.C. Zaghdoudi, et al., "Use of Heat Pipes for Avionics Cooling", 2000 Electronics Packaging Technology Conference, © 2000 IEEE, pp. 425-430.

Bernd Gromoll, "Advanced Micro Air-Cooling Systems for High Density Packaging", Tenth IEEE Semi-Therm, © 1994 IEEE, pp. 53-58.

Streamlight, Inc., "Introducing the New Survivor from Streamlight", http://www.streamlight.com/survivor_info.htm, printed Jun. 22, 2006, 1 page.

Streamlight, Inc., "Survivor Specifications", http://www.streamlight.com/survivor_specifications.htm printed Jun. 22, 2006, 2 pages.

Streamlight, Inc., "Survivor Parts & Accessories", http://www.streamlight.com/survivor_accessories_2001.htm printed Jun. 22, 2006, 1 page.

Streamlight, Inc., "Syclone Assembly C130000A", 1999, 1 page.

International Searching Authority, "PCT Notification of Transmittal of the International Search Report and the Written Opinion", Application No. PCT/US2010/057225, Jan. 26, 2011, 13 pages.

Thermacore, Inc., "Power Module Cooling", www.thermacore.com/power, printed Nov. 4, 2008, 3pgs.

Thermacore, Inc., "Heat Exchanger Applications", www.thermacore.com/heatexch, printed Nov. 4, 2011, 5 pgs.

"GE Scientists Employ Jet Engine Cooling Technology in Prototype LED Bulb", www.led-professional.com/technology . . . , Oct. 22, 2010, 3 pages.

Nuventix, "Active LED Thermal Management", www.nuventix.com, printed Oct. 29, 2010, 1 page.

Wikipedia, "Thermal Management of Electronic Devices and Systems" http://en.wikipedia.org, printed Nov. 2, 2010, 7 pages.

Wikipedia, "Heat Sink" http://en.wikipedia.org, printed Nov. 2, 2010, 22 pages.

"Optimization of Heat Sink Design and Fan Selection in Portable Electronics Environment", 6 pgs, Author Unknown, date prior to Nov. 17, 2010.

AAVID Thermalloy, LLC, "Heat Sink Selection Guide", www.aavidthermalloy.com/products/index, © 2010, printed Nov. 2, 2010, 63 pages.

TaiSol Electronics, "BTX Thermal Modules", www.taisol.com/btx, printed Nov. 2, 2010, 11 pages.

Tyco Electronics, "Heat Sink Assemblies Product Feature Selector", www.tycoelectronics.com/catalog, printed Nov. 2, 2010, 5 pages.

Wobblelight, "The Toughest Worklight on the Planet", www.woblelight.com, © 2009, printed Nov. 2, 2010, 7 pages.

Ansys, "Electronics", www.fluent.com/solutions/examples, printed Nov. 2, 2011, 3 pages.

Zalman, "Z-machine GV1000 VGA Cooler", www.amazon.com/zalman-z-machine . . . , printed Nov. 2, 2010, 7 pages.

(56) References Cited

OTHER PUBLICATIONS

Zalman, "ZM-VF1000LED Silent Blue LED VGA Cooler", www.amazon.com/zalman-zm-vf1000 . . . , printed Nov. 2, 2010, 7 pages.
Zalman, "VF900-Cu Copper VGA Video Card Cooler", www.amazon.com/zalman-vf900 . . . , printed Nov. 2, 2010, 8 pages.
Zalman, "VF700-Cu Copper Ultra-Quiet VGA Video Card Cooler", www.amazon.com/zalman-vf700 . . . , printed Nov. 2, 2010, 8 pages.
StarTech, "Pentium 4 Heatsink and Fan for P4 Pga478", www.amazon.com/gp/product . . . , printed Nov. 2, 2010, 7 pages.
StarTech, "Universal VGA Card Heatsink & Fan", www.amazon.com/Universal-vga-card . . . , printed Nov. 2, 2010, 8 pages.
Koolance, "CPU Cooler", www.koolance.com/technical/cooling101/005, printed Oct. 21, 2008, 2pages.
Wikipedia, "Heat Pipe" http://en.wikipedia.org, printed Oct. 21, 2008, 7 pages.
Lytron, "Heat Exchanger Overview", www.lytron.com/heat_exchangers, printed Oct. 21, 2008, 4pages.
Tracy V. Wilson, "How Liquid-Cooled PCs Work", http://computer.howstuffworks.com, © 1998-2008, 7 pages.
Streamlight, Inc., "Fire Vulcan LED Operating Instructions", © 2008, 2 pages.
Streamlight, Inc., "Vulcan—Fire Vulcan LED Operating Instructions", © 2008, 2 pages.
Streamlight, Inc., "LiteBox/FireBox (Rechargeable) Operating Instructions", © 2005, 6 pages.

* cited by examiner

PORTABLE LIGHT HAVING A HEAT DISSIPATER WITH AN INTEGRAL COOLING DEVICE

This Application claims the benefit of U.S. Provisional Patent Application No. 61/264,058 filed Nov. 24, 2009 and entitled "PORTABLE LIGHT HAVING A HEAT DISSIPATER WITH AN INTEGRAL COOLING DEVICE" which is hereby incorporated herein by reference in its entirety.

The present invention relates to a portable heat dissipater and, in particular, to a portable heat dissipater including a cooling device.

The light source for the next generation of professional use flashlights and other portable lights will likely be light-emitting diodes (LED's) almost exclusively. Efficient operation of these LED flashlights requires that the LED, the electronic circuit which controls the operation of the LED, or both, be relatively free from high temperature produced by excess heat. Many of such lights will employ LEDs that produce high light output and consequently also produce significant heat. The presence of excessive heat could result in the failure of the circuit and the failure of the LED light source due to their being heated to an excessive temperature. Therefore, the removal and/or dissipation of the heat that is generated by the LED and/or by the electronic circuit which controls the LED and/or by any other heat generating element is necessary for the efficient and reliable operation of the flashlight.

For certain LED lights it is sufficient to thermally mount the LED to a passive heat sink which conducts heat generated by the LED away from the LED so as to be dissipated primarily by convection, e.g., by exposure of all or part of the heat sink to the atmosphere. To improve convection cooling, the heat dissipater may have fins, posts or other features that increase the surface area that the atmosphere is in contact with.

Presently, LED's and other heat generating elements in flashlights generate heat which accumulates and circulates in an area proximate to the LED or LED subassembly. The presence of a heat sink is only effective to the extent that it is large enough to draw heat away from the LED and to dissipate a sufficient amount of that heat to maintain the LED temperature for efficient operation of the LED. This typically requires direct exposure to an external atmosphere for enhancing the dissipation or transfer of heat from the LED to the atmosphere. Neither or these two solutions is seen to be practical for a professional use flashlight where smallness of size and coolness to touch are features that matter to a user, and where long run times and high light output is required.

Streamlight, Inc. of Eagleville, Pa., has devised a number of effective ways to manage the heat generated by an LED employed as the light source in a flashlight. U.S. Patent Publication No. 2008-0018256 entitled "LED FLASHLIGHT AND HEAT SINK ARRANGEMENT" describes a heat sink arrangement which utilizes thermally conductive elements or members to which the LED and the control circuit are attached to or in thermal contact in order to remove heat from the circuit and the LED, thereby reducing the risk of a performance fault, or, worse, creation of a condition where a fault could result in a dangerous condition depending on where the flashlight is used. The latter is an example of a condition measured by a UL standard regarding flashlights for use in intrinsically dangerous circumstances.

Streamlight, Inc. has been issued U.S. Pat. No. 7,357,534, entitled "FLASHLIGHT PROVIDING THERMAL PROTECTION FOR ELECTRONIC ELEMENTS THEREOF," which relates to a thermally conductive heat sink having a heat dissipating element and a heat collecting element and the use of a thermally conductive material between the electronic circuit and the second surface of the heat sink, thereby thermally coupling the LED and the electronic circuit to the heat sink.

Even those advantageous arrangements may not be adequate for very high power LEDs and/or other heat generating elements employed in a compact configuration. The more heat to be dissipated, the greater the dissipater surface area required to dissipate that heat. As LED light output and the waste heat generated thereby increase, a passively dissipating heat sink can become too large or too heavy or too bulky to be practical. Further, at higher heat dissipation levels, the exposed elements of the heat sink could become sufficiently hot as to potentially become a safety concern.

Accordingly, there is a need for a heat dissipater for a portable light or other apparatus that is more compact than a passive heat sink capable of dissipating the same heat. Desirably, if such heat dissipater were to have an exposed part, the exposed part would preferably operate at a lower temperature than would a passive heat sink of equivalent size.

To this end, a heat dissipater may comprise: a heat sink having a heat generating element thermally coupled thereto, and having a plurality of walls for defining a cavity and plural passages in fluid communication with the cavity; a fluid mover disposed in the cavity of the heat sink for selectively causing a fluid to move through the cavity and the plural passages defined by the walls of the heat sink; and the heat generating element thermally coupled to the heat sink.

The heat dissipater may be employed in a portable light or other portable device or apparatus, with or without a housing.

BRIEF DESCRIPTION OF THE DRAWING

The detailed description of the preferred embodiment(s) will be more easily and better understood when read in conjunction with the FIGURES of the Drawing which include.

Figure 1:
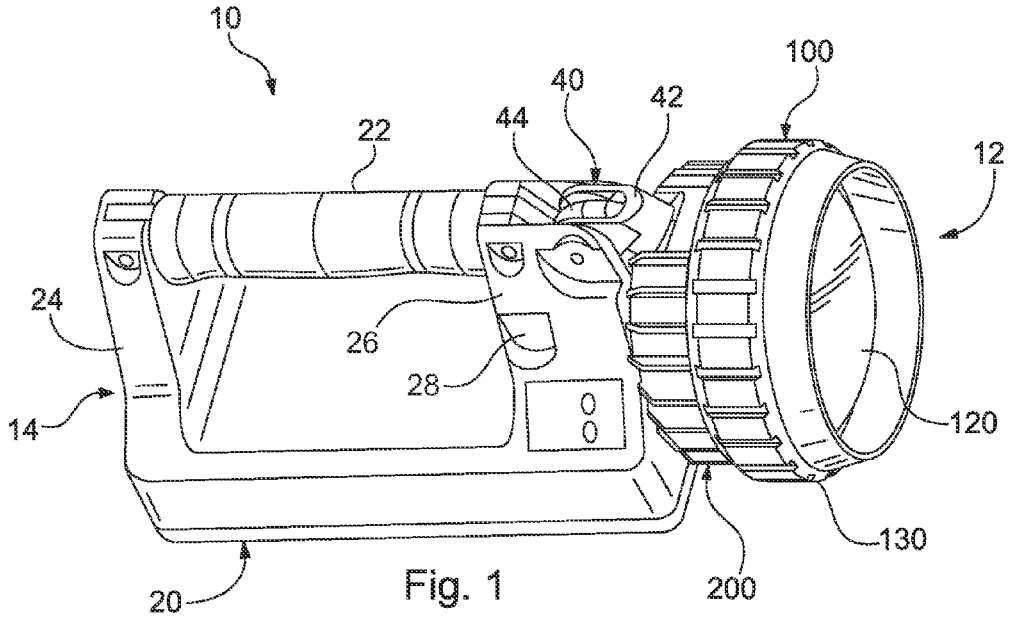
FIG. 1 is an isometric view of an example embodiment of a portable light in a lantern configuration that includes a heat dissipater according to the present arrangement.

In the Drawing, where an element or feature is shown in more than one drawing figure, the same alphanumeric designation may be used to designate such element or feature in each figure, and where a closely related or modified element is shown in a figure, the same alphanumerical designation primed or designated "a" or "b" or the like may be used to designate the modified element or feature. Similarly, similar elements or features may be designated by like alphanumeric designations in different figures of the Drawing and with similar nomenclature in the specification. It is noted that, according to common practice, the various features of the drawing are not to scale, and the dimensions of the various features are arbitrarily expanded or reduced for clarity, and any value stated in any Figure is given by way of example only.

DESCRIPTION OF THE PREFERRED EMBODIMENT(S)

In the disclosed heat dissipater, a cooling device typically including a fan is employed to dissipate heat collected by a heat sink that is thermally coupled to a light-emitting diode (LED) subassembly that is located in the head of a portable light, e.g., a flashlight. In the preferred embodiment, the cooling device (fan) is integral to, embedded in and/or a part of, the heat sink to which the LED subassembly is thermally attached. The heat sink and integral fan create a heat dissipater system for the fast, continuous, and efficient dissipation of heat. This thermal control system allows the LED to be maintained more closely to a relatively constant predetermined operating temperature, regardless of variations and/or changes of the intensity of the LED, the current it draws, or the energy it dissipates. The predetermined operating temperature is preferably selected to be close to an "optimum" operating condition for the LED, as that may be defined or desired by an LED manufacturer or a light designer.

The ability to maintain a constant operating temperature for the LED, preferably at or near its "optimum" operating temperature, provides an improvement over the current art. The disclosed heat sink with integral cooling device (e.g., an integral or embedded fan) maintains a sufficiently low temperature so as to conduct a greater flow or volume of heat as generated by high powered LED's no matter how long the run time or how high the light output may be. The greater the degree of cooling provided by the heat sink, which is accomplished in the disclosed arrangement, the greater the ability of the heat sink to collect and dissipate heat which typically results in an environment or operating condition suitable for the efficient use of high powered, long running LED's.

The use of electric fans to cool electronic devices such as computers and appliances is not new. These fans increase air flow so as to increase cooling. Generally, these fans are attached to or are external to a heat sink and they are often large in size—a condition which make such fans impractical for use in a flashlight or other portable light. In addition, electric fans can consume substantial power which is undesirable in a flashlight or portable device because it would greatly compromise the time that a given battery could power the light, and increasing the size (and thus the weight) of the battery is undesirable and in some cases impractical. The present arrangement addresses these problems by making the cooling device fan integral to, embedded in and/or a part of the heat sink, and/or by controlling its operation.

Several electrical blower and electrical fan configurations are commercially available. "Axial fans" move air parallel to the axis of rotation of the fan and provide relatively high flow rates and low pressures. By contrast, "centrifugal fans" or "radial blowers" move air perpendicular to the blower rotational axis and provide relatively low flow rates and high pressures. Other available configurations include tube axial fans, vane axial fans, crossover (tangential) blowers, and multistage blowers.

The configuration of the cooling device and the head sink in the present arrangement will be determined, at least in part, by the size and shape of the flashlight, lantern, or other portable light, with which it will be utilized. The fact that the cooling device is a part of or is integral to the heat sink can improve cooling efficiency and can save considerable space, thereby allowing the disclosed heat dissipater with integral cooling device to be useful for small flashlights while typically allowing the LED run time and/or light output to increase.

FIG. 1 is an isometric view of an example embodiment of a portable light 10 in a lantern 10 configuration that includes a head assembly 100 having a heat sink 200 according to the present arrangement. Example lantern 10 includes a generally rectangular housing 20 having a forward or head end 12 from which light is projected and a rearward end 14. Housing 20 typically may include handle supports 24, 26 that extend in like direction for supporting a handle 22 therebetween by which light 10 may be held. Through bolts or pins or rivets (not shown) are typically employed to attach handle 22 to supports 24, 26, and such bolts or pins may support respective rings to which a shoulder strap or other strap or lanyard (not shown) may be attached.

Light 10 and housing 20 thereof are generally similar to the LITEBOX® lights which are commercially available from Streamlight, Inc., of Eagleville, Pa., except that the heads of those lights employ a shaped plastic rear piece and not a heat dissipater as described herein. While similar, the FIREBOX® light and the VULCAN® light, which are also available from Streamlight, Inc., do not employ a heat dissipater as described herein.

Light producing head 100 is connected to housing 20 near the head end of lantern 10. Head assembly 100 is attached to housing 20 by a pivotable connection 40 that includes a swivel connector 42 and a flexible electrical cable 44 that carries electrical conductors for making operative electrical connections between the light source of head 100 and a battery disposed in housing 20. Swivel connector 42 is preferable attached to heat sink 210 of head 100 by a hollow metal eyelet (not shown) that is passed through hole 46 in heat sink 210 (the head of the metal eyelet bears against heat sink 210) and through a hole in the cylindrical portion 43 of connector 42 into the space between ears 45 thereof, where it extends through a metal washer on which it is peened or rolled over to permanently attach connector 42 to head 100.

A through bolt (not shown) passing through holes in ears 45 of connector 42 and through holes of forward handle support 26 is typically employed to attach swivel connector 42 to forward handle support 26 and typically employs a wing nut or other hand tightenable and loosenable nut to facilitate adjustment of the angle of head 100 relative to housing 20 by a user of light 10.

Head assembly 100 includes a heat dissipater 200 that is described herein below, a lens 120 for protecting the light source of head 100 and/or for shaping the light beam produced thereby, and a retaining ring 130 that attaches to heat dissipater 200 for retaining lens 120 and other elements of head 100.

Lantern 10 is typically controlled, e.g., turned on and off, and into other operating modes such as flashing or dimming or the like as may be provided, by an electrical switch which is typically mounted on or near forward support 26 in a location convenient for a user. In the arrangement shown, such switch is on the far side of support 26 which is not visible, where it is in a location for convenient activation by a right handed user. Additionally, or alternatively, a control switch may be provided near location 28 on support 26. Light 10 may also include external terminals for making electrical connection to a battery charger where a rechargeable battery is employed. Typically such terminals are located on housing 20 for making electrical contact to a source of charging, e.g., when light 10 is placed into a charger station or dock.

Housing 20 may also include one or more electronic circuit boards for carrying electronic circuits for controlling the charging and/or discharging of the battery, and/or for controlling operation of the light source contained in head 100. In lights 10 intended for use in fire and rescue environments, one or more blue lights may be provided at the rear of housing 20, and the operation thereof, e.g., in a steady on mode or in a flashing mode, may be controlled by circuitry located on circuit board 32.

Figure 2:
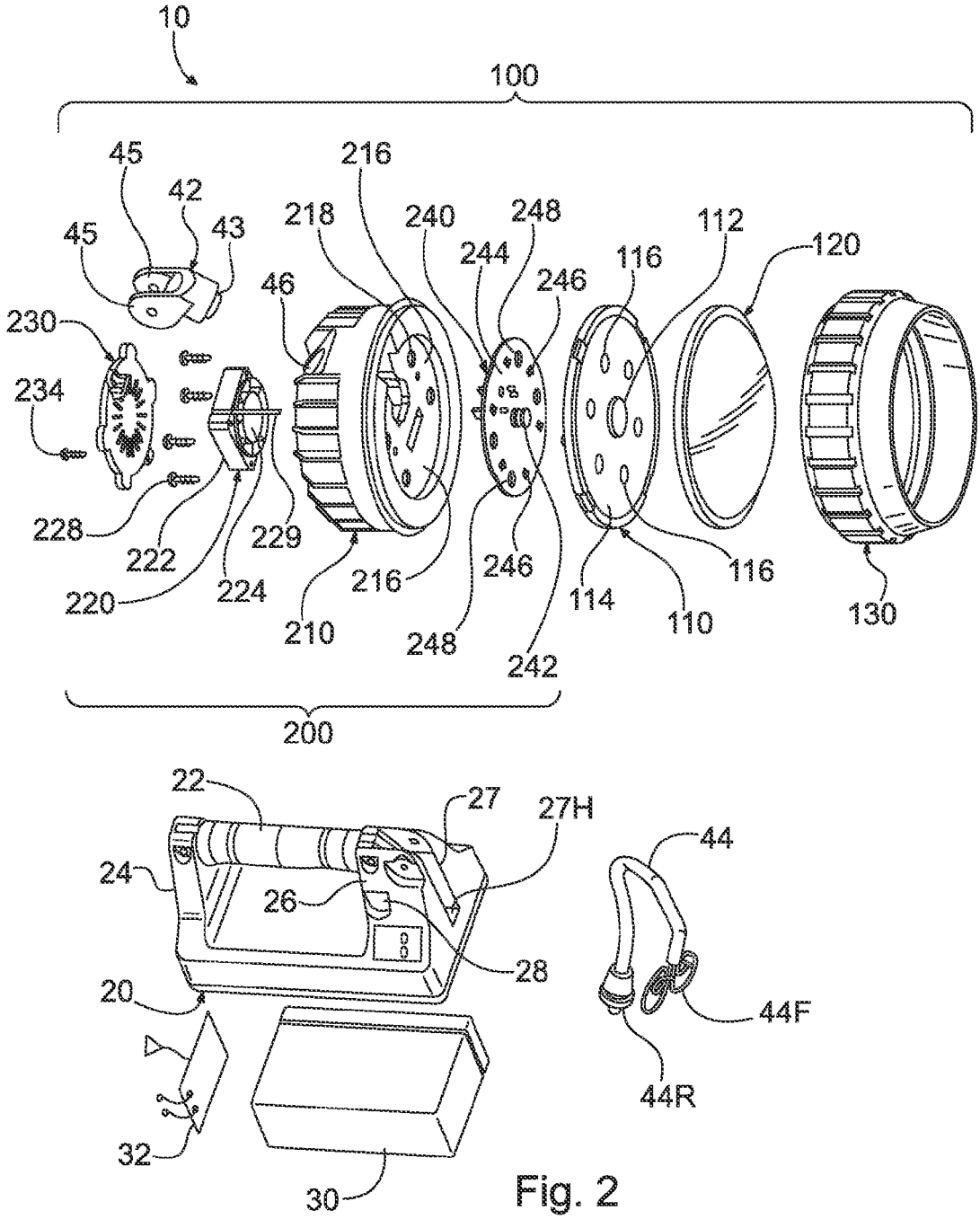
FIG. 2 is a partial exploded view of the example portable light of FIG. 1.

FIG. 2 is a partial exploded view of the example portable light 10 of FIG. 1. Battery 30 is seen to be insertable into housing 20 at the bottom thereof and is typically retained in housing 20 by a cover that is attached to the bottom thereof. The cover may be gasketed to provide a seal against the entry of dirt, debris, moisture or other unwanted materials into housing 20, and may have feet for light 10 to rest upon when placed on a horizontal surface. Where battery 30 is a rechargeable battery 30, housing 20 may also house an electrical or electronic circuit 32 for connecting and/or interfacing a rechargeable battery 30 to a battery charger external to housing 20 and light 10.

Head assembly 100 includes a heat dissipater 200 to which are attached other elements of head 100 that relate to either the light producing function thereof or to the heat dissipating function. Heat dissipater 200 includes a generally circular thermally-conductive heat sink 210 that has a generally flat forward-facing face or surface 216 to or against which light source 240 and various elements 110, 120, 130 relating to light source 240 may be attached for conducting heat to thermally conductive heat sink 210. Specifically, light source 240 includes an LED 242 that is mounted to an electronic circuit board 244 that is disposed adjacent to the relatively flat face 216 of heat sink 210 for the conduction of heat thereto. Heat conduction may be by direct physical contact between circuit board 244 and heat sink 210, and may be enhanced by the use of thermally conductive material, e.g., a thermally conductive paste or grease, a thermally conductive adhesive, or a thermally conductive membrane, therebetween. Circuit board 244 of light source 240 may typically have holes 248 that align with holes 218 of heat sink 210 for receiving respective screws, pins or other fasteners for retaining light source 240 pressed against flat surface 216 of heat sink 210 in a desired location, thereby to provide thermal coupling therebetween.

Preferably the relatively flat forward-facing surface 216 of heat sink 210 is recessed to define an annular wall having a shape that is substantially the shape of the periphery of circuit board 244 of light source 240, so that circuit board 244 is registered to a proper position relative to heat sink 210 thereby. Typically, that registration results in LED 242 being substantially on a central axis of heat sink 210 and the central axes of reflector 110, lens 120 and retaining ring 130. Reflector 110 typically has substrate 114 having a circular shape similar to that of lens 120 and ring 130.

Light source may comprise a high power LED 242, which typically is centrally located on circuit board 244, and may include additionally or alternatively a plurality of LEDs 246 arrayed on circuit board 244. LEDs of array 246 are typically evenly spaced in a circular pattern surrounding LED 242, and typically are lower power LEDs than is LED 242. Light 10 may be controlled for operation such that only LED 242 is on, or some or all of LEDs 246 are on, or that both LED 242 and LEDs 246 are on at the same time. In addition, control circuitry for LEDs 242, 246 may provide for selecting different levels brightness for some or all of LEDs 242, 246, e.g., dimming and un-dimming of some or all of LEDs 242, 246, and/or blinking and flashing modes of operation of some or all of LED 242 and/or LEDs 246.

Reflector 110 preferably has a plastic LED cover 112 centrally located in substrate 114 for covering LED 242 of light source 240, and cover 112 may simply be a cover, e.g., for protection, or may have a contoured shape and/or thickness so as to serve as a lens for shaping the light produced by LED 242. Reflector 110 preferably has plural small reflectors 116, typically small parabolic reflectors 116, that align with corresponding small LEDs 246 on circuit board 244 for shaping the beam of light produced by such small LEDs 246. Small reflectors 116 may be sized and shaped, e.g., made relatively deep or relatively shallow, or relatively wider or relatively narrower, so as to shape the beams of light produced by LEDs 246 in a desired manner, e.g., for providing a spot or a flood of light, or something in between.

Where reflector 110 is a molded plastic, LED cover 112 and small reflectors 116 may be molded into substrate 114. Where reflector 110 includes a metal substrate 114, LED cover 112 and small reflectors 116 may be plastic inserts that are fitted into holes in metal substrate 114 or small reflectors 116 may be formed by pressing or stamping the metal of substrate 114. A metal substrate may improve heat removal from LED 242 and LEDs 246 somewhat, e.g., by providing a path for heat transfer transversely in a direction across the face 216 of heat sink 210 and/or by providing an additional path for heat transfer from the LEDs 242, 246 to the rim of base 216 of heat sink 210.

Circular lens 120 is disposed against reflector 110 and is retained thereat by retaining ring 130 that attaches at the outer cylindrical periphery of heat sink 210, e.g., by ring 130 and heat sink 210 each having threads so as to be threadable together or by ring 130 being elastic and having a projection (e.g., a flange or ridge) or a recess (e.g., a groove or indentation) that corresponds with a recess or projection of heat dissipater 200 so as to snap together or otherwise engage. An O-ring or other gasket or seal may be provided between retaining ring 130 and heat sink 210 and/or between lens 120 and ring 130 to resist the entry of dirt, debris, moisture and other unwanted materials into head 100.

Heat sink 210 preferably also has a network of fluid passages defined by various walls and fins thereof for the efficient dissipation (removal) of heat produced by light source 240. An example wall and fin structure of heat sink 210 is better viewed and is described in relation to FIG. 3. A fluid mover 220, typically an air moving fan 220, is disposed in or embedded into the rear of heat sink 210 and is retained therein by four screws or other fasteners 228, and typically has electrical wires 229 extending from frame 222 for making electrical connection to electrical circuit board 240 for receiving electrical power to operate air mover 220.

Swivel connector 42 attaches to a hole 46 of heat dissipater 200, e.g., by a hollow metal eyelet, and flexible cable 44 wraps around swivel connector 42 between ears 45 and passes through the metal eyelet between heat dissipater 210 and housing 20. Typically cable 44 has electrical wires at the end 44F that connects to head 200, e.g., for connecting to circuit board 244 of light source 240, and has an enlarged elastic stress reliever at the end 44R that attaches to housing 20, e.g., to relieve mechanical stress at a hole 27H within a relatively large slot 27 near the forward end of housing 20 as cable 44 flexes. Thus, electrical cable 44 may flex and move in slot 27 and connector 42 to allow head 100 to swivel with respect to housing 20 so that a user may direct the light produced by head 20 in a desired direction.

Figure 3A:
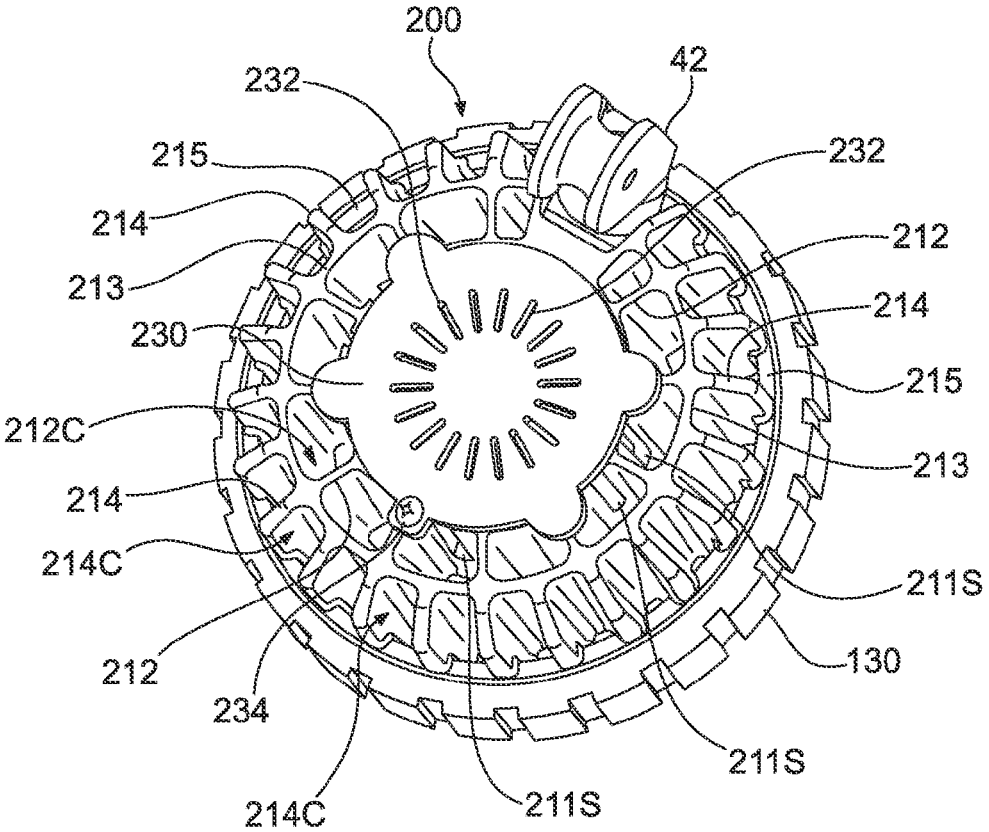
FIG. 3 includes FIGS. 3A and 3B which are rear isometric views of an example heat dissipater and FIG. 3C which is a side cross-sectional view thereof.
Figure 3B:
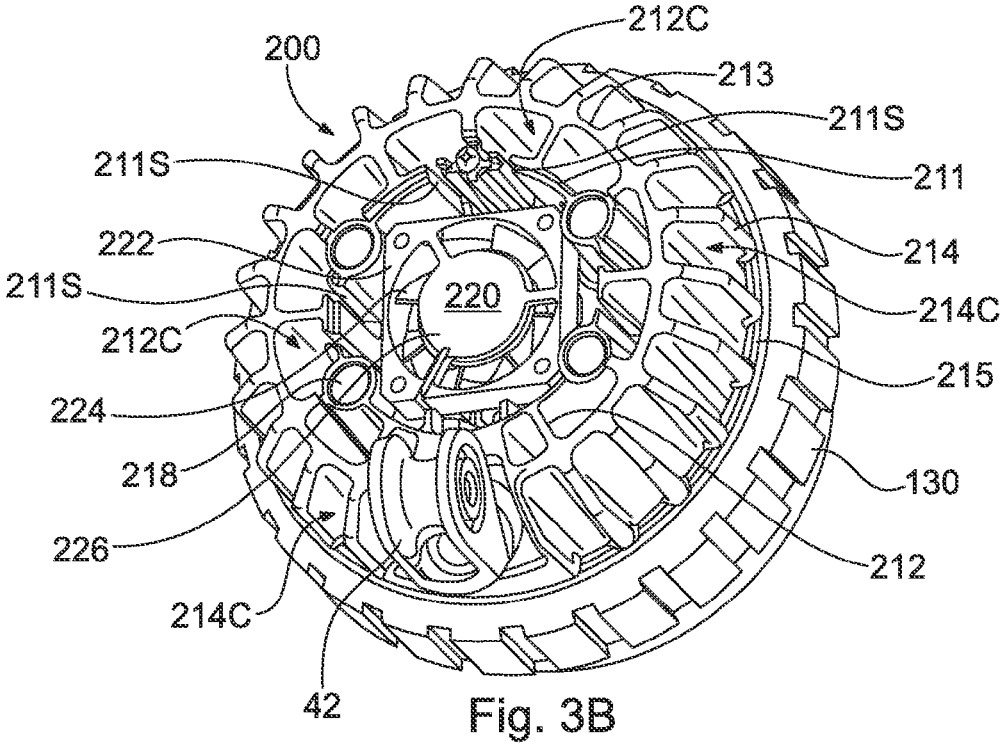
Figure 3C:
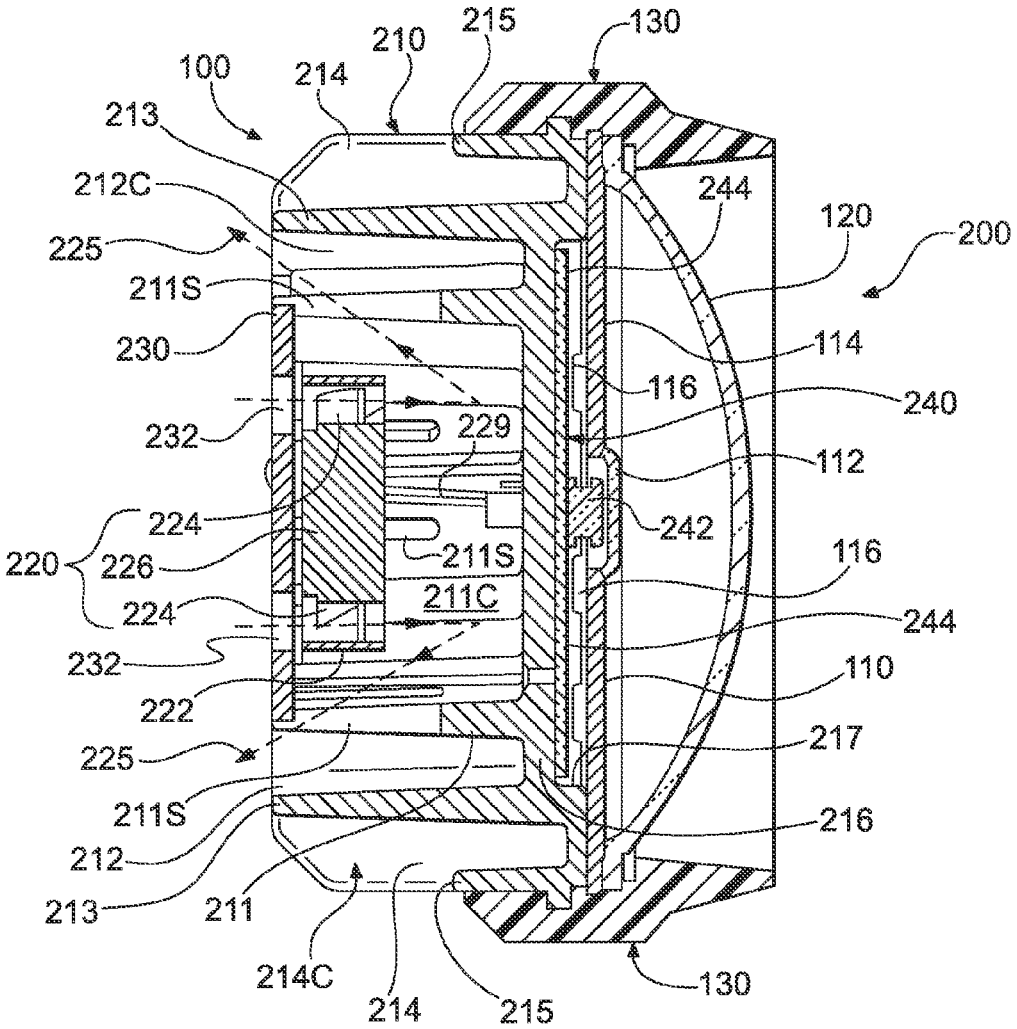

FIG. 3 includes FIGS. 3A and 3B which are rear isometric views of an example heat dissipater 200 and FIG. 3C which is a side cross-sectional view thereof. Heat dissipater 200 includes a heat sink 210 that has a plurality of passages for the flow of a fluid therethrough, e.g., air. In general, heat sink 210 may be described as having a circular base 216 from one side of which extend plural coaxial generally circular walls 211, 213, 215 to define respective coaxial cylinders. Each of circular walls 211, 213, 215 provides additional surface area for enhancing the transfer of heat from heat sink 210 to the surrounding fluid (air) as well as defining passages through which such fluid may flow for further enhancing the dissipation of heat by heat dissipater 200. The opposite side of circular base 216 provides a generally flat surface or face 216 for receiving electronic circuit board 244 of light source 240 adjacent thereto and thermally coupled thereto, typically, with a thermal grease or thermally conductive adhesive or other thermally conductive compound so as to enhance the thermal coupling between light source 240 and heat sink 210.

Inner circular wall 211 defines a generally cylindrical cavity 211C with base 216 closing the bottom end thereof. The end of the cavity 211C defined by circular wall 211 distal from base 216 is arranged for receiving an air moving device 220 therein. For example, an axial fan 220 may be disposed (embedded) therein with its frame 222 supported by shoulders or ledges of wall 211 and its electrical wires 229 may connect through base 216 to electronic circuit board 244 for receiving electrical power for operating fan 220. Such shoulders or ledges preferably may have axial holes therein for receiving screws or other fasteners 228 that secure embedded fan 220 to heat sink 210, e.g., by passing through holes in frame 222 thereof, so that the stator 226 or motor 226 of fan 220 is at the outer end of cavity 211C so that rotor 224 of fan 220 rotates for moving air into or out of cavity 211C.

A cover 230 placed over embedded fan 220 and secured to wall 211 by a screw or other fastener 234 substantially closes the cavity 211C defined by wall 211 and base 216. Cover 230 has a plurality of openings 232 therethrough, preferably radial slots 232 that are arranged to align with the annular space through which blades of rotatable rotor 224 of fan 220 may move air axially into or out of the cavity 211C. Wall 211 has a plurality of openings or slots 211S therethrough which provide plural passages through which air may move radially into or out of cavity 211C.

Heat sink 210 has an outer generally circular wall 215 that substantially coincides with the circular periphery of circular base 216 and has an intermediate generally circular wall 213 that is between inner circular wall 211 and outer circular wall 215. Preferably, heat sink 210 further includes a plurality of radial wall segments 212 between inner circular wall 211 and intermediate circular wall 213, and a plurality of radial wall segments 212 between intermediate circular wall 213 and outer circular wall 215.

Each adjacent pair of radial wall segments 212 defines with the adjacent portions of circular walls 211, 213 a fluid (air) cavity or passage 212C and a majority of these cavities 212C are connected with cavity 211C by slots 211S in circular wall 211. In the example heat sink 210 as illustrated, there are twelve such cavities 212C (ten relatively larger and two relatively smaller cavities) and eight of the cavities 212C are connected by a slot 211S with cavity 211C. Preferably, circular walls 211, 213 extend about the same height from base 216.

Each adjacent pair of radial wall segments 214 defines with the adjacent portions of circular walls 213, 215 a fluid (air) cavity or passage 214C and preferably the number of these cavities 214C is substantially greater than the number of cavities 212C. In the example heat sink 210 as illustrated, there are twenty-two such cavities 214C, e.g. approximately two times the number of cavities 212C. Preferably, circular wall 215 extends a lesser distance, e.g., about half of the height or less, from base 216 than does wall 213, thereby to facilitate natural air passage into and out of cavities 214C for removing heat from walls 213, 214, 215. While ones of cavities 214C could be connected to ones of cavities 212C, e.g., by openings in circular wall 213, they need not be so connected.

In the example heat dissipater 200 illustrated, the flow of air moved in heat sink 210 by air mover 220 is preferably through slots 232 into cavity 211C, through slots 211S into cavities 212C and then rearwardly to be expelled from cavities 212C. Such flow is shown, e.g., by dashed line 225. The air so moved initially makes contact with base 216 to which heat produced by LED 242 is conducted, and then makes contact with walls 211, 212 and 213 to which heat may flow from base 216. Reasons for preferring that air mover 220 move air in the direction described include that the incoming relatively cooler air initially contacts base 216 which is believed to enhance heat transfer from heat sink 210 and that embedded fan 220 is itself cooled by such relatively cooler air which is believed to tend to extend the useful life of fan 220.

As shown in FIG. 3C, electronic circuit board 244 of light source 240 supports LED 242 generally in a central region thereof, and is adjacent to base 216 of heat sink 210, preferably in good thermal contact therewith. Reflector 110 includes a circular portion 114 that is adjacent light source 240 and a dome portion 112 that surrounds and protects LED 242, and which may be utilized as a lens for shaping the light produced by LED 242. Light source 240 and reflector 110 are secured to heat dissipater 200 by fasteners that extend through respective holes in circuit board 244 and reflector 110 into base 216 of heat sink 210. Preferably such fasteners are of a heat conducting material so as to enhance heat transfer from light source 240 to heat sink 210.

In a preferred embodiment, heat sink 210 has a recess 217 in face 216 thereof that has a shape and size that corresponds to the shape and size of the periphery of circuit board 244. As a result, when circuit board 244 is placed in recess 217 of heat sink 210 it is disposed in a predetermined position relative to heat sink 210, e.g., so that centrally located LED 242 is located in the position in which it will properly align with reflector 110 and lens 120 of light head assembly 100. Further, the periphery of circuit board 244 and the periphery of recess 217 are preferably not circularly symmetric, so that the rotational position of circuit board 244 relative to heat sink 210 is also predetermined and connection points of circuit board 244 will be in the proper locations for receiving electrical conductors, e.g., electrical leads 229 of air mover fan 220 and lead wires 44F of wire cable 44, which pass through one or more openings in heat sink 210.

LED 242 may be mounted to circuit board 244 in any of several ways. For example, LED 242 could be mounted through a hole in circuit board 244 so that the base of LED 242, from which heat generated by LED 242 may be conducted, can be directly against the surface 216 of heat sink 210. Alternatively, LED 242 may be mounted to the surface of circuit board 244 as illustrated and circuit board 244 may include thermally conductive features adjacent to LED 242 and proximate to LED 242 for transferring heat from LED 242 to base 216 of heat sink 210. Such thermally conductive features may include, e.g., conductive areas on one or both sides of circuit board 244, conductive vias through circuit board 244, solder-filled holes through circuit board 244, thermally conductive metal fasteners for securing circuit board 244 to heat sink 210, and the like.

In particular, an array of plated-through holes may be provided in circuit board 244 at a location over which a heat generating component will be mounted, which holes fill with solder when circuit board is soldered, so as to provide an array of thermally conductive vias for conducting heat away from such component. In general, features that increase thermal mass, thermal conductivity and/or the thermally conductive area of contact will generally improve heat transfer.

Figure 4:
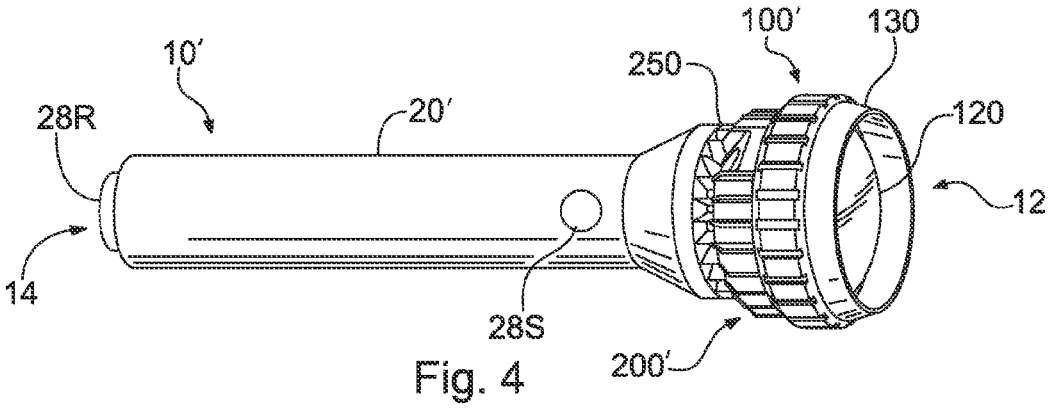
FIG. 4 is an isometric view of an example embodiment of a portable light in a flashlight configuration that includes a heat dissipater according to the present arrangement.

FIG. 4 is an isometric view of an example embodiment of a portable light 10' in a flashlight 10' configuration that includes a heat dissipater 200' according to the present arrangement. Flashlight 10' includes a housing 20' at a forward end 12 of which is located a head assembly 100' that selectively produces light. Typically housing 20' includes one or more switches 28 for selectively controlling the production of light, and has an internal cavity for receiving a source of electrical power, e.g., a battery. Switches 28 may include, e.g., a switch 28S located on the side of housing 20', typically closer to the forward end 12 thereof, and possibly on the head 100' thereof, and/or a switch 28R located at the rearward or tail end 14 thereof. Such switches 28S, 28R may operate independently or in coordination for controlling all or some of the operation of light 10'.

Head 100' at the forward end 12 of light 10' includes a light source and may include electrical and/or electronic circuits for operating and/or controlling the light source. Head assembly 100' includes a heat dissipater 200' along with a reflector 110 and lens 120 that are retained with heat dissipater 200' by a retaining ring 130, all as described above.

Figure 5:
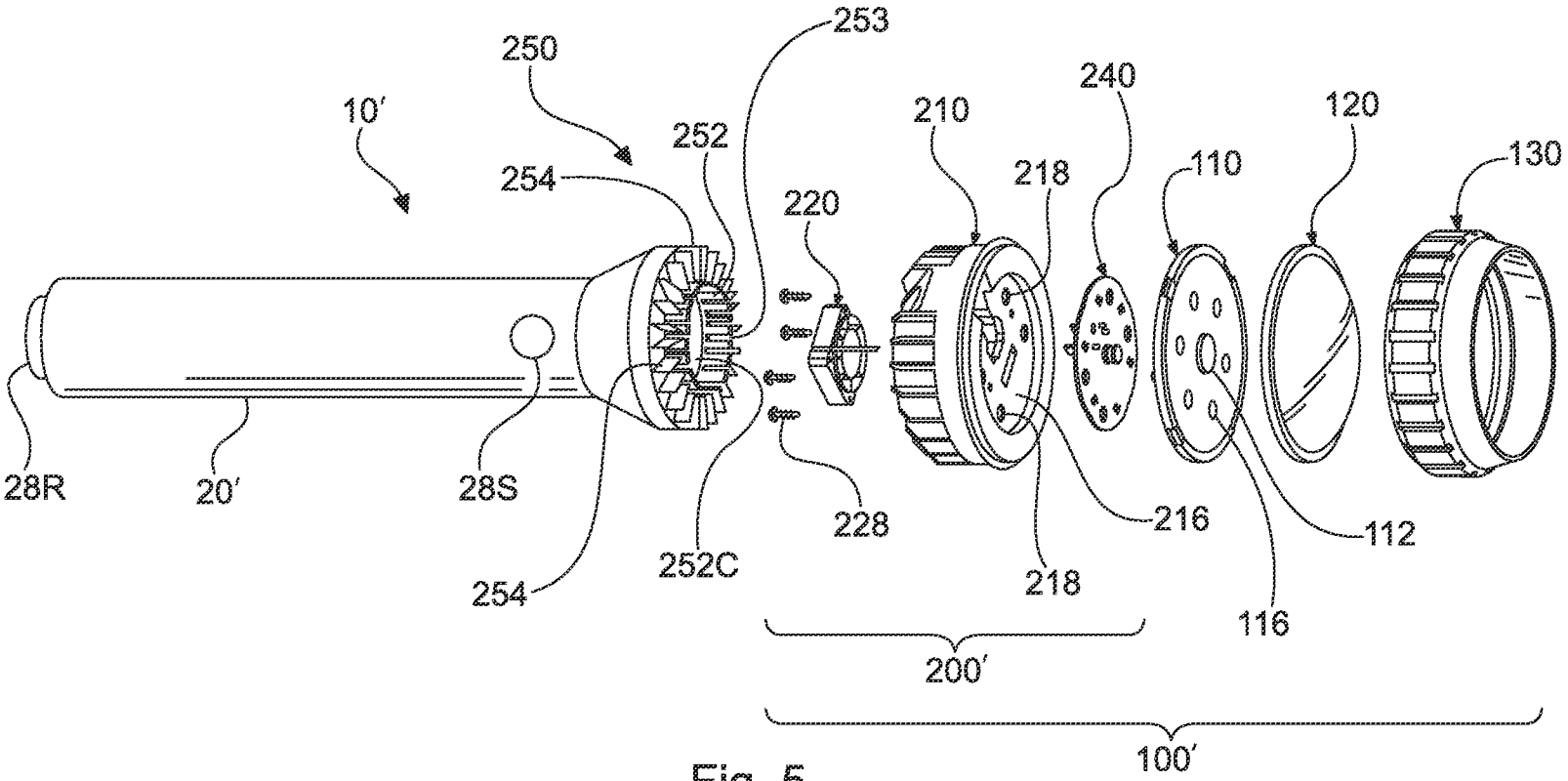
FIG. 5 is a partial exploded view of the example portable light of FIG. 4, and FIGS. 5A and 5B are isometric views of the rear of the example heat dissipater of FIG. 5 and of a baffle therefor, respectively.
Figure 5A:
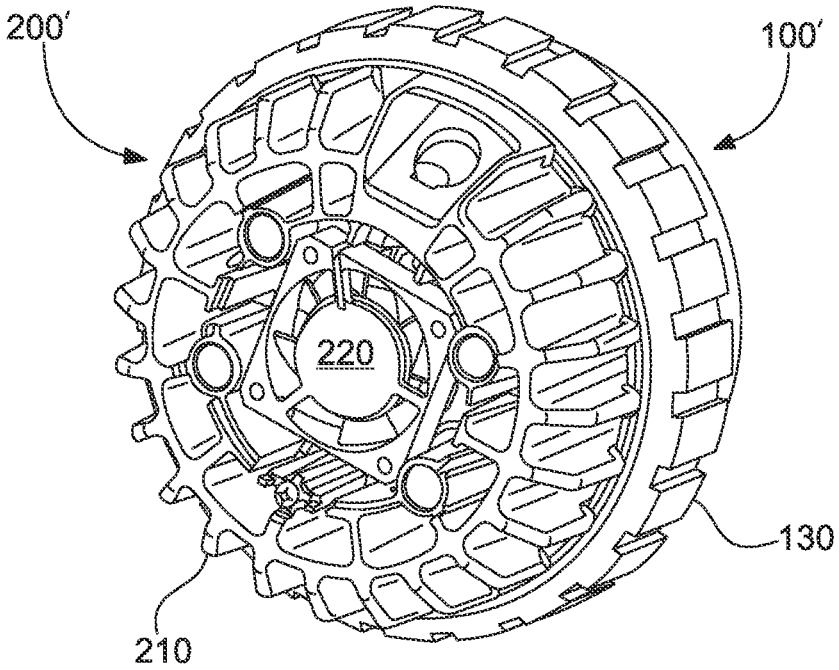
Figure 5B:
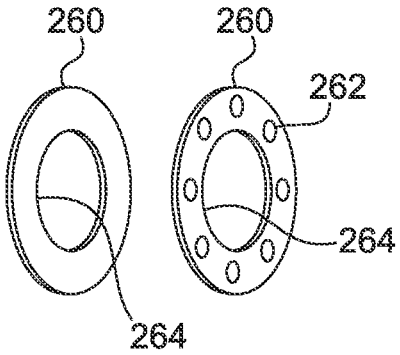

FIG. 5 is a partial exploded view of the example portable light 10' of FIG. 4, and FIGS. 5A and 5B are isometric views of the rear of an example flashlight head 100' having a heat dissipater 200 of FIG. 5 and of a baffle 260 therefor, respectively. Flashlight head 100' and heat dissipater 200' may be identical to light head 100 and heat dissipater 200, respectively, except that cover 230 is preferably omitted and swivel connector 42 may optionally be omitted, if desired, as is illustrated. Thus the description of head 100 and heat dissipater 200, and their function, above also describes flashlight head 100' and heat dissipater 200' and their function.

In the case of portable light 10 above, which is a lantern 10, the rear of heat dissipater 200 is exposed, and so air may circulate around and within heat dissipater 200 relatively unaffected by the housing 20 of lantern 10. Such is not the case, however, for portable light 10' which is in the configuration of a flashlight because flashlight housing 20' thereof would tend to block the rear of heat dissipater 200' and thus would interfere with the circulation of air in and around heat dissipater 200'.

To allow head assembly 100' to attach to housing 20' while having suitable circulation of air in and around heat dissipater 200', housing 10 preferably includes provisions for integrating with heat dissipater 200' in a way that allows the desired thermodynamic condition. A suitable mechanical and thermal interface 250 between housing 20' and heat dissipater 200' includes walls and air passages that cooperate with the walls and air passages of heat sink 100' to allow the flow of air inward to embedded fan 220 which is integrated into and/or embedded in heat sink 210.

Head assembly 100' may be attached to flashlight housing 20' by all or some of the screws or other fasteners that extend into or through holes 218 in heat sink 210 extending further than heat sink 210 to engage corresponding holes of interface 250 of flashlight housing 20' or by two or more screws or other fasteners inserted through housing 20' to engage heat dissipater 200', e.g., two or more of the holes 218 of heat sink 210. Alternatively, interface 250 may be threadable or otherwise attachable onto and off of housing 20' and so may be attached to heat dissipater 200' by screws or other fasteners that pass through holes in interface 250 and into holes 218 of heat sink 210, or interface 250 may be threadable to housing 20' and to heat dissipater 200'.

Air passage defining elements 250 serve to channel air being drawn to embedded fan 220 which is completely surrounded by heat sink 210 and elements 250 without a cover 230 being needed. Interface 250 includes a generally circular wall 252 extending forwardly toward head end 12 of light 10' and being of similar diameter to that of circular wall 213 of heat sink 210 with which it is generally coaxial. Circular wall 252 has a plurality of openings or slots 253 therein through which air may flow to reach the cavity 252C within circular wall 252 from which it may be drawn through air mover 220 into and through heat sink 210.

Interface 250 further includes radial walls 254 that extend radially outward from circular wall 252 to further define air flow passages. While air flowing from heat sink 210 may generally escape radially outwardly between walls 254, walls 254 provide additional surface area that can also serve to dissipate heat. When appropriate given the amount of heat to be dissipated by dissipater 200' and interface 250, an annular baffle 260 or other shaped baffle 260 may be provided between dissipater 200' and interface 250, or as part of either one or both of them, so as to direct the flow of air through heat dissipater 200' and interface 250 in a suitable manner, e.g., to separate the relatively cooler air flowing in from the relatively warmer air flowing out.

The particular arrangement of such baffle 260 would be defined in consideration of the respective locations of slots 211S of heat sink 210 and of slots 253 of interface 250 for defining desired respective passages through which the cooling fluid, e.g., air, may flow into and out of heat dissipater 200'. Typically, a flat annular baffle 260 could have a central opening 264 having a diameter similar to or slightly smaller than the diameter of cylindrical wall 252, which diameter would typically be similar to the diameter of cylindrical wall 211 of heat sink 210, and could have an outer diameter that is similar to or slightly larger than the outer diameter of interface 250 and/or cylindrical wall 213 of heat sink 210 which would have slots therein for allowing the cooling fluid to pass radially outwardly through wall 213. Where adjacent pairs of radial fins 254 define passages through which air may flow into cavity 252C and other adjacent pairs of radial fins 254 define passages through which air may flow from outwardly from cavities of heat sink 210, baffle 260 may have openings 262 therethrough for allowing air flowing out of the cavities of heat sink 210 into the passages between adjacent radial fins 254 of interface 250, in addition to central opening 264.

Figure 6A:
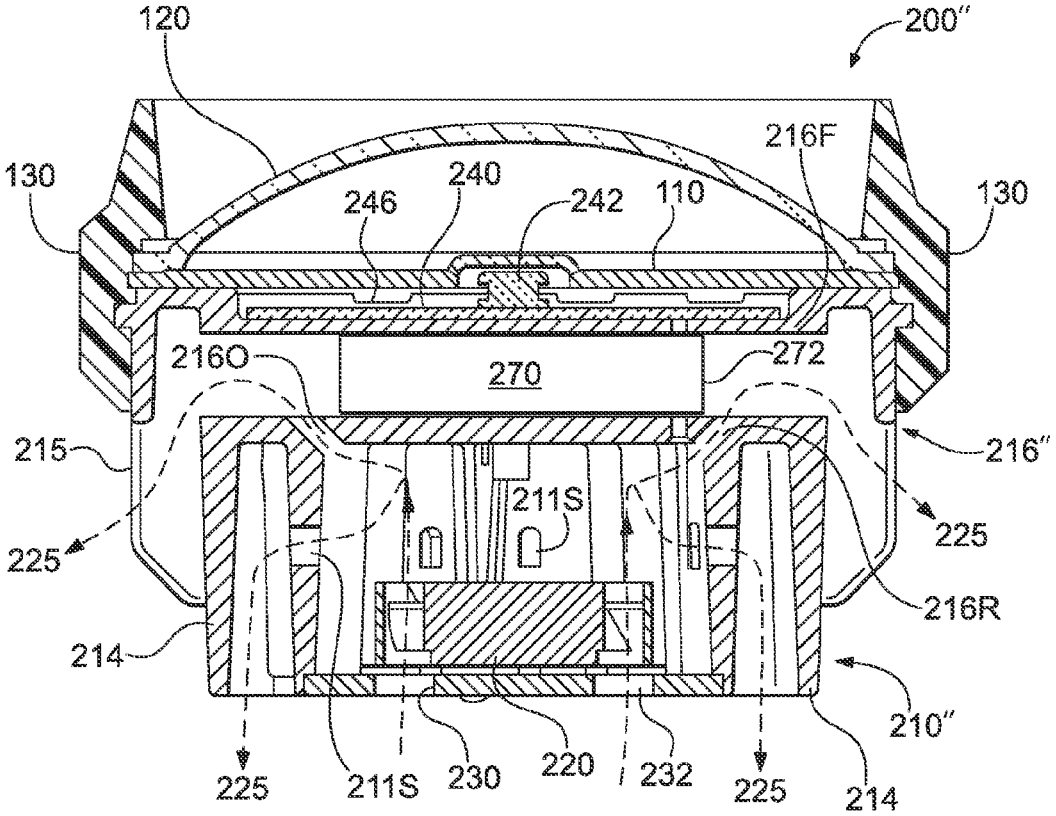
FIG. 6 includes FIG. 6A which is a cross-sectional view and FIGS. 6B and 6C which are isometric views of an alternative embodiment of a heat dissipater according to the present arrangement.
Figure 6B:
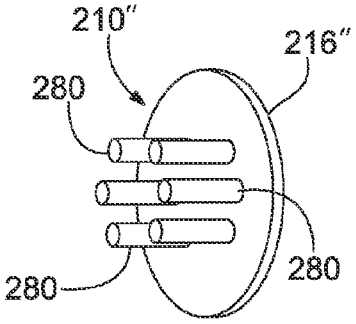
Figure 6C:
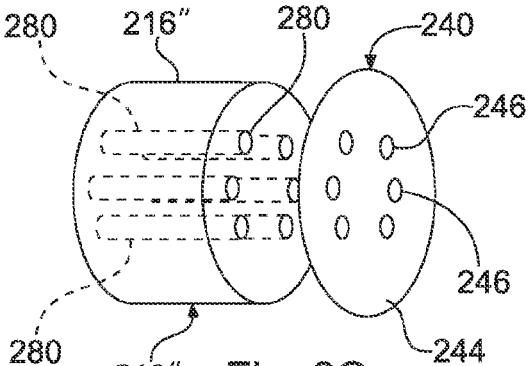

FIG. 6 includes FIG. 6A which is a cross-sectional view and FIGS. 6B and 6C which are isometric views of an alternative embodiment of a heat dissipater 200" according to the present arrangement, which may be similar to heat dissipater 200, 200' as described above. Heat dissipater 200" includes at least one heat pipe 270, 280 for conducting heat from a warmer location near which heat is generated to a cooler location where heat may be dissipated. A heat pipe is known to have a closed cavity in which is a working fluid that evaporates to a vapor at a relatively warmer location and condenses to a liquid at a relatively cooler location, thereby to transfer heat from the relatively warmer location to the relatively cooler location. A wick may be provided within the closed cavity of a heat pipe to assist the return of the liquid condensed working fluid from the relatively cooler location to the relatively warmer location by capillary action. Suitable working fluids may include, e.g., ammonia, water, methanol, ethanol, and acetone.

In FIG. 6A, heat pipe 270 is disposed between the first side 216F of base 216" of heat sink 210" and the second side 216R thereof for transferring heat from LED 242 and/or LEDs 246 to walls 211-215 from which it may be removed by cooling fluid, e.g., air, passing thereby. Heat pipe 270 has a cavity 272 therein in which a working fluid is disposed. Heat pipe 270 may include a casing that defines an interior cavity thereof containing the working fluid thereof, or the cavity containing working fluid may be provided within the circular base 216" of heat sink 210" without a separate casing. Heat sink 210" may include plural additional passages 216O through base 216" through which cooling fluid moved by fan 220 may be caused to flow, e.g., in an axially forward and/or radially outward direction. By way of example, slots 211S of heat sink 210" are shown relatively smaller than those of heat sink 210 and air flow caused by fan 220 passes through both openings 211S and 216O, as indicated by dashed arrows 225.

In FIGS. 6A and 6B are shown a set of relatively long, relatively small diameter heat pipes 280 that are disposed at least in part in base 216" of heat sink 210" in an array generally corresponding to an array including plural LEDS, e.g., LEDs 246 of light source 240 circuit board 244 adjacent heat sink 210" (shown simplified). In this arrangement, light source 240 may or may not include a central relatively larger LED 242. Each heat pipe 280 has a cavity therein in which a working fluid is disposed. Each heat pipe 280 may include a casing that defines the cavity containing the working fluid thereof, as shown in FIGS. 6B and 6C, or the cavity containing working fluid may be provided within the circular base 216" of heat sink 210" without a separate casing, e.g., by drilled or bored blind holes that are covered after a working fluid is placed therein, as shown in FIG. 6C. Where heat pipes 280 having a separate casing are employed, they may be of sufficient length to extend through the circular base 216" as illustrated in FIG. 6B into the fluid passages defined by the various walls 211-215 of heat sink 210" for being in direct thermal contact with the cooling fluid passing and/or moving through heat sink 210".

Heat sink 210" while shown in a simplified form, preferably includes various walls defining various fluid passages through which air mover 220 may cause fluid, e.g., air, to flow for efficiently dissipating heat from a heat source thermally coupled to heat sink 210" to the surrounding environment. The arrangement of heat sink 210" allows it to be included in a head for a portable light, e.g., a light in a lantern configuration or in a flashlight configuration or in an area light configuration or in anther desired configuration.

Figure 7:
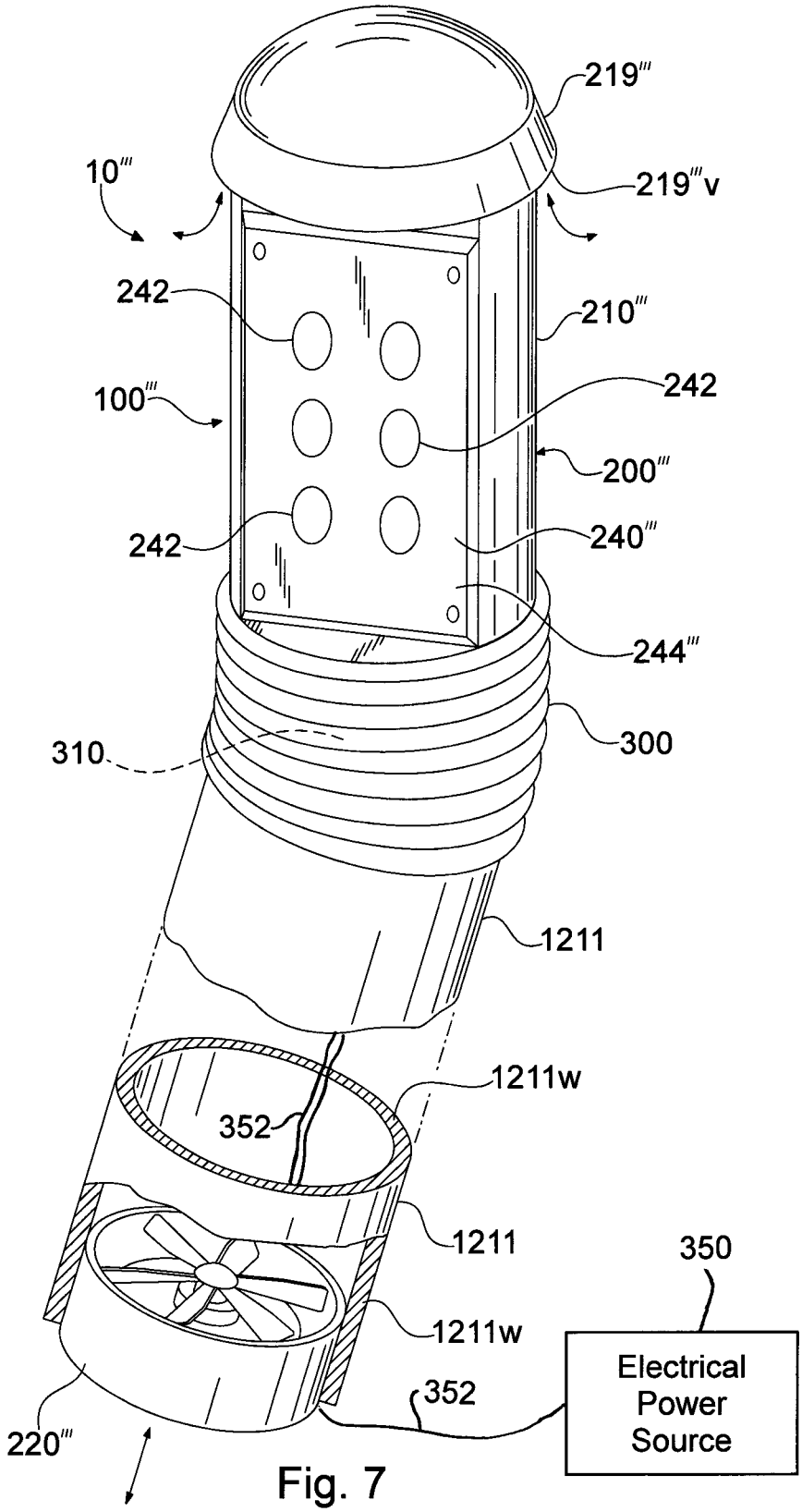
FIG. 7 is an isometric view of an example embodiment of a portable light in an area light configuration that includes a heat dissipater according to the present arrangement.
Figure 8:
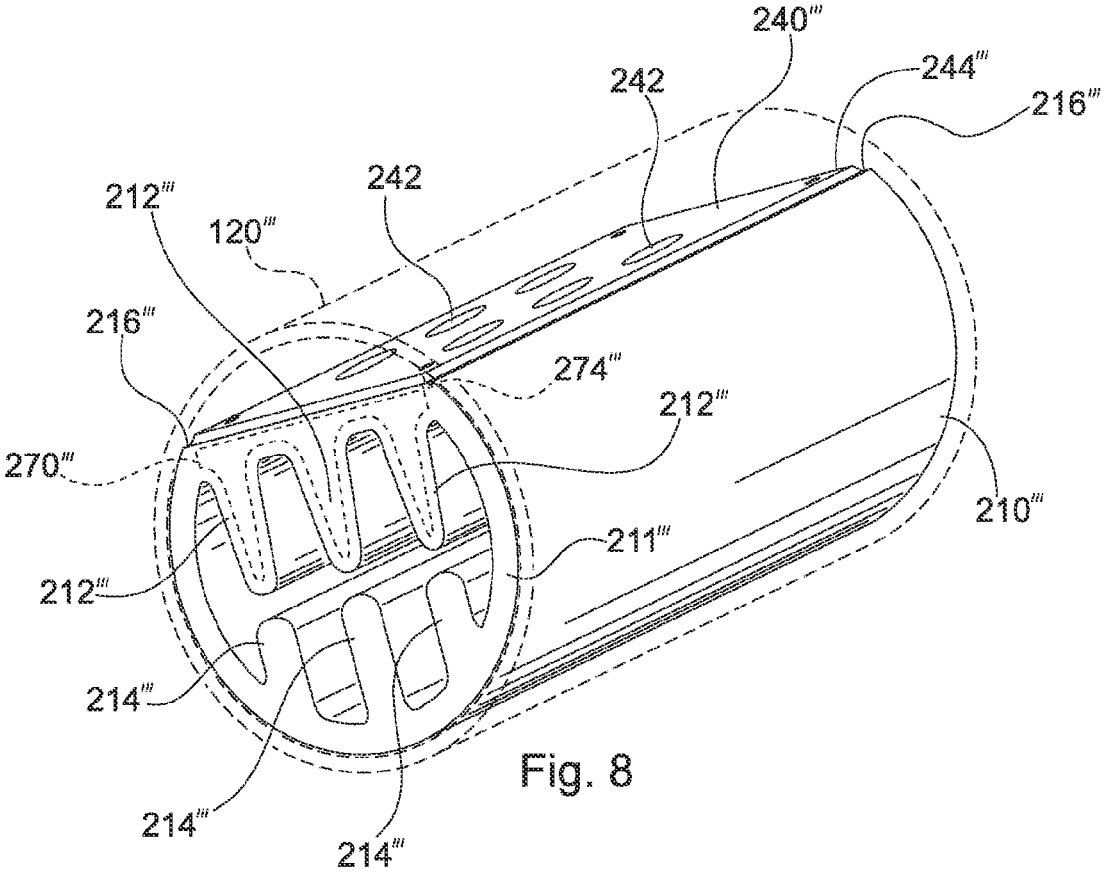
FIGS. 8 and 8A are a partial view of the example portable light of FIG. 7 and of a detail thereof.
Figure 8A:
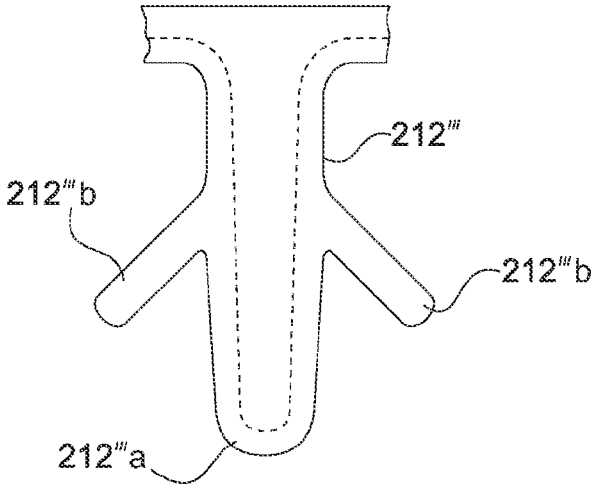

FIG. 7 is an isometric view of an example embodiment of a portable light 10'" in an area light configuration that includes a heat dissipater 200'" according to the present arrangement, and FIGS. 8 and 8A are partial views of the example portable light 10'" of FIG. 7 showing details thereof. Portable area light 10'" includes a head assembly 100'" comprising a heat dissipater 200'" including a heat sink 210'" to which is mounted a light source 240'". Heat sink 210" of head assembly 200'" typically includes circular wall 211'" and interior walls 212'", 214'" that define fluid passages through which a fluid, most typically air, can flow. Walls 212'", 214'" may be of any desired shape and so may have parallel sides as illustrated for walls 214'" or may be tapered as illustrated for walls 212'". Double ended arrows at the vents 219'"V of venting cover 219'" and at the end of hollow tubular member 1211 indicate that fluid may be made to flow in one direction or the other, e.g., as by a fluid mover 220'" integrally disposed in tubular member 1211, typically near an end thereof remote from dissipater 200'".

Light 10'" preferably includes a hollow tubular member 1211 to which head assembly 100'" is physically connected by a movable joint 310 (not visible). Preferably, the movable joint may be an articulated joint 310 permitting movement of head 100'" with at least two degrees of freedom relative to member 1211. The articulated joint may include one or more pivotable connections pivotable in one or more different planes or may include a ball and socket connection providing degrees of freedom of relative movement in plural planes. Tubular member 1211 has a generally circular wall 1211*w* that defines a fluid passage through member 1211 and essentially extends from heat sink 210'" to fluid mover 220'". A flexible sheath 300 is preferably provided between tubular member 1211 and head 100'" for defining a fluid passage therebetween, e.g., providing fluid communication between respective fluid passages in tubular member 1211 and in head 100'".

In an example embodiment wherein head assembly 100'" is generally cylindrical, heat dissipater 200'" is generally cylindrical and has a relatively flat base surface 216'" upon which is disposed light source 240'". Light source 240'" may comprise an electronic circuit board 244'" upon which are mounted a plurality of light emitting diodes (LEDs) 242, typically higher power LEDs. A lens 120'" may be provided to cover light source 240'" and generally prevent dirt and other debris from being deposited thereon. Lens 120'" may simply be a transparent or translucent cover of rectangular or arcuate shape that covers light source 120'" or lens 120'" may be a cylindrical lens that surrounds light source 120'" and heat sink 210'" as shown. A reflector may be provided for LEDs 242, e.g., in similar manner to that described regarding reflector 110 hereinabove, but is not necessary, particularly where a flood of light over an area is desired.

Circuit board 244'" is generally planar and is mounted in thermal communication with base surface 216'" of heat sink 210'" for conducting heat generated by LEDs 242 to heat sink 210'". Circuit board 244'" typically has features for thermally coupling LEDs to heat sink 210'" such as thermally conductive vias, a metal or other thermally conductive core, or openings for allowing LEDs 242 to be directly thermally coupled to base surface 216'" of heat sink 210'", and may be attached to base surface 216'" by fasteners, e.g., screws, pins, clips and the like, thermally conductive adhesive or other suitable means.

Heat sink 210'" has a generally circular wall 211'" defining a fluid passage and has walls 212'" and 214'" extending therefrom for further defining a fluid passage for the fluid, typically air, moved by fluid mover 220'", typically an electrical fan. Walls 211'", 212'", 214'" increase the area that fluid moving through heat sink 210'" contacts thereby to improve heat transfer and lower thermal resistance. Walls 212'", 214'" typically have a tapered cross-sectional shape to improve heat conduction therethrough.

Wall configurations other than that illustrated may be employed to achieve a desired degree of heat transfer in view of the flow of fluid provided by fluid mover 220'". For example, walls 212'" and/or 214'" may have a more complex cross-sectional shape for providing greater surface area. In one example, shown in FIG. 8A, wall 212'" has sideways extending arms 212'''*b* on opposite sides thereof and an end 212''' a at the end thereof. Preferably, heat sink 210''' has walls 211''', 212''', 214''' in a configuration that allows heat sink 210''' to be extruded, e.g., extruded aluminum.

Optionally, heat sink 210''' may include a heat pipe 270''' to further enhance heat transfer from LEDs 242. A heat pipe 270''' may be a thin rectangular heat pipe disposed between light source 240''' and the base 216''' of heat sink 210''' or may be a more complex shape to complement the shapes of walls 211''', 212''' as illustrated. The cavity of heat pipe 270''' which contains a working fluid may be formed in part by the extrusion of heat sink 210''', e.g., extending into the central regions of radial walls 212'''. and in part by a cover 274''', e.g. at the open ends thereof. While a thin rectangular heat pipe may be provided as a separate part that is attached to heat sink 210''', a heat pipe 270''' of more complex cross-section preferably is provided by covering a cavity formed in the extruding of heat sink 210'''.

An electrical power source 350, e.g., a battery, generator or connection to an external power source 350, may be located at or near the end of tubular member 1211 remote from head 100''' for powering fan 220''' as well as light source 240''', or may be located closer to or in head 100'''. Electrical power may be conducted to head 100''' via electrical wires 352, e.g., electrical wires 352 passing through the interior of member 1211 and flexible sheath 300.

Venting cover 219''' is preferably at the upper end of head assembly 100''' where light 10''' is intended for outdoor use for providing a cover 219''' to keep rain and other debris from entering head 100'''. Vents 219'''*v* thereof may preferably be provided by one or more openings located circumferentially around the bottom periphery of venting cover 219''' so as to not capture falling rain or debris.

Figure 9:
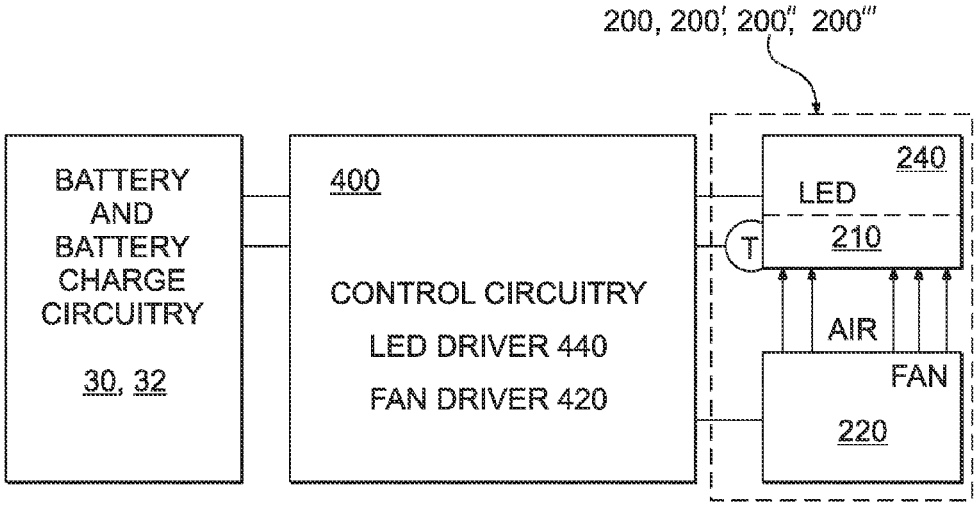
FIG. 9 is a schematic diagram of example electrical and/or electronic circuits suitable for use in the described portable light.

FIG. 9 is a schematic diagram of example electrical and/or electronic circuits 400 suitable for use in the described portable light 10, 10'. Circuit board 244 of light source 240 may typically carry all or part of the electronic circuitry 400 utilized for operating light source 240 and/or air mover (fan) 220. Such circuitry 400 may include current and/or voltage control and regulation for LED 242 and for small LEDs 246, including predetermined varying thereof as a function of temperature, for operating LEDs 242, 246 at desired current levels, brightness levels and/or temperatures. One example desirable operating condition for high power LED 242 would be to regulate the current flowing through LED 242 to be at or near a condition of high efficiency of conversion of electrical energy into light, and also to operate air mover 220 so as to tend to maintain LED 242 at a temperature at which its efficiency is high.

In addition, a control circuitry 400 for air mover 220 may also be provided on circuit board 244 so that air mover 220 may be made to operate or operate faster as temperature increases and to cease to operate or to operate more slowly as temperature decreases. Preferably, fan 220 operates responsive to temperature as sensed relatively close to high power LED 242, but may be sensed at heat sink 210, e.g., near surface 216, or at a location on circuit board 244. Temperature may be sensed by any convenient temperature sensitive element, e.g., by a thermistor, or by a thermostatic or other thermally responsive switch.

Electrical power provided by battery 30 and charging circuit 32 is coupled to control circuitry 400 which controls the selective application of electrical power to light source 240 which includes LED 242 and LEDs 246 for producing light, responsive to operation of switch SW, e.g., by a user. Switch SW may be operative for controlling the LED driver 440 of circuitry 400 for turning light source 2400N and OFF, either momentarily or continuously, and may also be operative to cause light source 240 to operate at different brightness levels, to dim and/or un-dim, and/or to cause light source 240 to flash or blink between ON and OFF conditions. The fan driver 420 of control circuitry 400 is responsive to thermal sensing device T for selectively applying electrical power to fluid mover 220, e.g., an air mover or fan, to cause fan 220 to move a cooling fluid, e.g., air, over heat sink 210 of dissipater 200 for dissipating the heat produced by operation of LED 242 and/or LEDs 246 and/or other heat producing elements, e.g., electrical or electronic components on circuit board 244.

By way of example, and not of limitation: Heat sink 210, 210'', 210''' may be made of aluminum or another suitable metal having good thermal conductivity, such as brass, or of a highly-thermally conductive resin, and may be cast, molded, or machined as a single piece, or may be made of a cast, molded or machined base to which a section of an extruded wall structure is attached, e.g., as by brazing or thermally-conductive adhesive. Cover 230 may be made of a metal, e.g., aluminum, or of a plastic. Reflector 110 may be made of a plastic, such as polycarbonate, or of a metal, e.g., aluminum, with one or more plastic inserts, by molding or pressing or stamping, Lens 120 may be made of similar plastic materials, and lens 120 and reflector 110 may be joined together at their peripheries, e.g., by heat or ultrasonic welding or by adhesive. Retaining ring 130 may be made of a suitable elastic material, such as a molded rubber, urethane or other plastic, so as to snap on over the rim of heat dissipater 200, 200', or may be of a suitable metal, e.g., aluminum, and have threads so as to engage threads on the rim of heat dissipater 200, 200'.

Also by way of example, and not limitation: Heat sink 210 may be about 4.65 inches (about 118 mm) in diameter and about 1.86 inch (about 47 mm) thick, and may be fabricated by machining, casting, molding, and/or extrusion, either as a single piece or as individual pieces, e.g., as an extruded wall structure 211-215 and a machined base 216 that are brazed or adhesively attached together. Fan 220 may be, e.g., an about 1.5×1.5 inches (about 38 mm×38 mm) rectangular axial fan operable from DC voltage, such as a GM series DC fan available from Sunon, Inc. (USA) located in Brea, Calif., and in China. LED 242 may be a type C4 high power LED available from the Philips Lumileds Lighting Company located in San Jose, Calif. or from Cree, Inc., located in Durham, N.C. Circuit board 244 may be made of FR4 or fiberglass-impregnated resin or other suitable material.

A portable light heat dissipater 200, 200', 200'', 200''' may comprise: a heat sink 210, 210', 210'' having a first side for having a light source 240 thermally coupled thereto, and having a plurality of walls 211-215 extending from a second side thereof for defining a cavity and plural passages in fluid communication with the cavity; a fluid mover 220 disposed in the cavity of heat sink 210, 210', 210'', 210''' for selectively causing a fluid to move through the cavity and the plural passages defined by the walls 211-215 of heat sink 210, 210', 210'', 210'''; and a light source 240 disposed adjacent to and thermally coupled to the first side of heat sink 210, 210', 210'', 210'''. Portable light heat dissipater 200, 200', 200'', 200''' may further comprise: an electronic circuit 400 proximate heat sink 210, 210', 210'', 210''' for controlling electrical power applied to light source 240; or an electronic circuit 400 proximate heat sink 210, 210', 210'', 210''' for controlling operation of fluid mover 220; or an electronic circuit 400 proximate heat sink 210, 210', 210'', 210''' for controlling electrical power applied to light source 240 and operation of fluid mover 220. Electronic circuit 400 may control electrical power applied to light source 240 or may control operation of fluid mover 220 or may control both responsive to the temperature of light source 240. Heat sink 210, 210', 210", 210'" may comprise a generally circular base providing the first side for having a light source 240 coupled thereto, and a plurality of generally cylindrical walls 211-215 extending from the base of heat sink 210, 210', 210", 210'", wherein an inner one of said cylindrical walls 211-215 defines the cavity for receiving fluid mover 220, and wherein at least one of cylindrical walls 211-215 has openings therethrough for defining the plural passages. The heat sink 210, 210', 210", 210'" may comprise a base 216 providing the first side for having the light source 240, 240', 240", 240'" coupled thereto, an enclosing wall 211'" extending from base 216 defining a passage and a plurality of generally radial walls 212'" extending from at least the base 216 of heat sink 210, 210', 210", 210'" into the passage defined by enclosing wall 211'" to define one or more of the plural passages adjacent base 216, and a hollow member 1211 extending therefrom defining a cavity in fluid communication with the plural passages, wherein hollow member 1211 defines the cavity for receiving fluid mover 220. An articulated connection 300 between heat sink 210, 210', 210", 210'" and hollow member 1211 and a flexible sheath 310 may enclose the articulated connection and providing a fluid passage between hollow member 1211 and heat sink 210, 210', 210", 210'. Heat sink 210, 210', 210", 210'" may include at least one heat pipe 270, 280 coupling the first and second sides thereof. Electronic circuit 400 may be disposed on a circuit board 244 defining a periphery of a given shape and size, and the heat sink 210, 210', 210", 210'" may have a recess 217 in the first side thereof, the recess having a shape and size corresponding to the given shape and size of the periphery of said circuit board 244, and the circuit board 244 may be disposed in the recess 217. Heat sink 210, 210', 210", 210'" may comprise a generally circular base providing the first side 216 for having a light source 240 or heat generating element 240 coupled thereto, and a plurality of generally cylindrical walls 211-215 extending from the base of said heat sink 210, 210', 210", 210'", wherein an inner one 211 of the cylindrical walls 211-215 defines the cavity 211C for receiving the fluid mover 220, and wherein at least one 211, 213 of the cylindrical walls 211-215 has openings 211S, 213S therethrough for defining the plural passages. Heat sink 210, 210', 210", 210'" may include at least one heat pipe 270, 280 coupling the first and second sides thereof. Heat generating element 240 may include: at least one light emitting diode 242, 246; or a high power light emitting diode 242; or an array of light emitting diodes 246; or a high power light emitting diode 242 and an array of light emitting diodes 246. Fluid mover 220 may include a fan 220 for moving air. Heat dissipater 200, 200', 200", 200'" may further comprise: a cover 230 adjacent fluid mover 220 and having openings 232 therethrough through which the fluid moved by fluid mover 220 moves; or a thermal interface 250 adjacent fluid mover 220 and defining passages through which the fluid moved by fluid mover 220 moves; or a thermal interface 250 adjacent fluid mover 220 and having a plurality of radial walls 254 defining passages through which the fluid moved by fluid mover 220 moves.

A portable light 10, 10' may comprise: a housing 20, 20' defining a cavity for receiving a source of electrical power therein; and a head 100, 100' connected to housing 20, 20' and including a light source 240, a reflector 120 and a heat dissipater 200, 200', 200", 200'". Heat dissipater 200, 200', 200", 200'" may comprise: heat sink 210, 210', 210", 210'" having a first side for having a light source 240 thermally coupled thereto, and having a plurality of walls 211-215 extending from a second side thereof for defining a cavity and plural passages in fluid communication with the cavity; and a fluid mover 220 disposed in the cavity of heat sink 210, 210', 210", 210'" for selectively causing a fluid to move through the cavity and the plural passages defined by the walls 211-215 of heat sink 210, 210', 210", 210'"; wherein light source 240 is disposed adjacent to and thermally coupled to the first side of heat sink 210, 210', 210", 210'". Portable light 10, 10' may further comprise: an electronic circuit 400 proximate heat sink 210, 210', 210", 210'" for controlling electrical power applied to light source 240; or an electronic circuit 400 proximate heat sink 210, 210', 210", 210'" for controlling operation of fluid mover 220; or an electronic circuit 400 proximate heat sink 210, 210', 210", 210'" for controlling electrical power applied to light source 240 and operation of fluid mover 220. Electronic circuit 400 may control electrical power applied to light source 240 or may control operation of fluid mover 220 or may control both responsive to the temperature of light source 240. Heat sink 210, 210', 210" may comprise a generally circular base providing the first side for having a light source 240 coupled thereto, and a plurality of generally cylindrical walls 211-215 extending from the base of heat sink 210, 210', 210", 210'", wherein an inner one 211 of cylindrical walls 211-215 defines the cavity for receiving fluid mover 220, and wherein at least one of cylindrical walls 211-215 has openings therethrough for defining the plural passages. The heat sink 210, 210', 210", 210'" may comprise a base 216 providing the first side for having the light source 240, 240', 240", 240'" coupled thereto, an enclosing wall 211'" extending from base 216 defining a passage and a plurality of generally radial walls 212'" extending from at least the base 216 of heat sink 210, 210', 210", 210'" into the passage defined by enclosing wall 211'" to define one or more of the plural passages adjacent base 216, and a hollow member 1211 extending therefrom defining a cavity in fluid communication with the plural passages, wherein hollow member 1211 defines the cavity for receiving fluid mover 220. An articulated connection 300 between heat sink 210, 210', 210", 210'" and hollow member 1211 and a flexible sheath 310 may enclose the articulated connection and providing a fluid passage between hollow member 1211 and heat sink 210, 210', 210", 210'. Heat sink 210, 210', 210", 210'" may include at least one heat pipe 270, 280 coupling the first and second sides thereof. A pivot connector 42 may connect heat dissipater 200, 200', 200", 200'" to housing 20, 20', wherein head 100, 100', 100", 100'" and housing 20, 20' are in a lantern configuration. A thermal interface 250 may connect heat dissipater 200, 200', 200", 200'" to housing 20, 20', wherein head 100, 100', 100", 100'" and housing 20, 20' are in a flashlight configuration. Electronic circuit 400 may be disposed on a circuit board 244 defining a periphery of a given shape and size, and the heat sink 210, 210', 210", 210'" may have a recess 217 in the first side thereof, the recess having a shape and size corresponding to the given shape and size of the periphery of said circuit board 244, and the circuit board 244 may be disposed in the recess 217. Heat sink 210, 210', 210", 210'" may comprise a generally circular base providing the first side 216 for having a light source 240 or heat generating element 240 coupled thereto, and a plurality of generally cylindrical walls 211-215 extending from the base of said heat sink 210, 210', 210", 210', wherein an inner one 211 of the cylindrical walls 211-215 defines the cavity 211C for receiving the fluid mover 220, and wherein at least one 211, 213 of the cylindrical walls 211-215 has openings 211S, 213S therethrough for defining the plural passages. Heat sink 210, 210', 210", 210'" may include at least one heat pipe 270, 280 coupling the first and second sides thereof. Heat generating element 240 may include: at least one light emitting diode 242, 246; or a high power light emitting diode 242; or an array of light emitting diodes 246; or a high power light emitting diode 242 and an array of light emitting diodes 246. Fluid mover 220 may include a fan 220 for moving air. Heat dissipater 200, 200', 200", 200''' may further comprise: a cover 230 adjacent fluid mover 220 and having openings 232 therethrough through which the fluid moved by fluid mover 220 moves; or a thermal interface 250 adjacent fluid mover 220 and defining passages through which the fluid moved by fluid mover 220 moves; or a thermal interface 250 adjacent fluid mover 220 and having a plurality of radial walls 254 defining passages through which the fluid moved by fluid mover 220 moves. The portable light 10, 10', 10''' may further comprise: a pivot connector for connecting heat dissipater 200, 200', 200", 200''' to the housing, wherein the head and housing are in a lantern configuration; or a thermal interface 250, 250' for connecting heat dissipater 200, 200', 200", 200''' to the housing, wherein the head and housing are in a flashlight configuration; or an articulated connection connecting heat dissipater 200, 200', 200", 200''' to the housing, wherein the head and housing are in an area light configuration.

A portable heat dissipater 200, 200', 200", 200''' may comprise: a heat sink 210, 210', 210", 210''' having a first side for having a heat generating element 240 thermally coupled thereto, and having a plurality of walls 211-215 extending from a second side thereof for defining a cavity and plural passages in fluid communication with the cavity; a fluid mover 220 disposed in the cavity of heat sink 210, 210', 210", 210''' for selectively causing a fluid to move through the cavity and the plural passages defined by the walls 211-215 of heat sink 210, 210', 210", 210'; and a heat generating element 240 disposed adjacent to and thermally coupled to the first side of heat sink 210, 210', 210", 210'. Portable heat dissipater 200, 200', 200", 200''' may further comprise: an electronic circuit 400 proximate heat sink 210, 210', 210", 210''' for controlling electrical power applied to heat generating element 240; or an electronic circuit 400 proximate heat sink 210, 210', 210", 210''' for controlling operation of fluid mover 220; or an electronic circuit 400 proximate heat sink 210, 210', 210", 210''' for controlling electrical power applied to heat generating element 240 and operation of fluid mover 220. Electronic circuit 400 may control electrical power applied to heat generating element 240 or may control operation of fluid mover 220 or may control both responsive to the temperature of heat generating element 240. Heat sink 210, 210', 210", 210''' may comprise a generally circular base providing the first side for having a heat generating element 240 coupled thereto, and a plurality of generally cylindrical walls 211-215 extending from the base of heat sink 210, 210', 210", 210''', wherein an inner one of said cylindrical walls 211-215 defines the cavity for receiving fluid mover 220, and wherein at least one of cylindrical walls 211-215 has openings therethrough for defining the plural passages. The heat sink 210, 210', 210", 210''' may comprise a base 216 providing the first side for having the light source 240, 240', 240", 240''' coupled thereto, an enclosing wall 211''' extending from base 216 defining a passage and a plurality of generally radial walls 212''' extending from at least the base 216 of heat sink 210, 210', 210", 210''' into the passage defined by enclosing wall 211''' to define one or more of the plural passages adjacent base 216, and a hollow member 1211 extending therefrom defining a cavity in fluid communication with the plural passages, wherein hollow member 1211 defines the cavity for receiving fluid mover 220. An articulated connection 300 between heat sink 210, 210', 210", 210''' and hollow member 1211 and a flexible sheath 310 may enclose the articulated connection and providing a fluid passage between hollow member 1211 and heat sink 210, 210', 210", 210'''. Heat sink 210, 210', 210", 210''' may include at least one heat pipe 270, 280 coupling the first and second sides thereof. Electronic circuit 400 may be disposed on a circuit board 244 defining a periphery of a given shape and size, and the heat sink 210, 210', 210", 210''' may have a recess 217 in the first side thereof, the recess having a shape and size corresponding to the given shape and size of the periphery of said circuit board 244, and the circuit board 244 may be disposed in the recess 217. Heat sink 210, 210', 210", 210''' may comprise a generally circular base providing the first side 216 for having a light source 240 or heat generating element 240 coupled thereto, and a plurality of generally cylindrical walls 211-215 extending from the base of said heat sink 210, 210', 210", wherein an inner one 211 of the cylindrical walls 211-215 defines the cavity 211C for receiving the fluid mover 220, and wherein at least one 211, 213 of the cylindrical walls 211-215 has openings 211S, 213S therethrough for defining the plural passages. Heat sink 210, 210', 210", 210''' may include at least one heat pipe 270, 280 coupling the first and second sides thereof. Heat generating element 240 may include: at least one light emitting diode 242, 246; or a high power light emitting diode 242; or an array of light emitting diodes 246; or a high power light emitting diode 242 and an array of light emitting diodes 246. Fluid mover 220 may include a fan 220 for moving air. Heat dissipater 200, 200', 200", 200''' may further comprise: a cover 230 adjacent fluid mover 220 and having openings 232 therethrough through which the fluid moved by fluid mover 220 moves; or a thermal interface 250 adjacent fluid mover 220 and defining passages through which the fluid moved by fluid mover 220 moves; or a thermal interface 250 adjacent fluid mover 220 and having a plurality of radial walls 254 defining passages through which the fluid moved by fluid mover 220 moves. The portable heat dissipater 200, 200', 200", 200''' may further comprise: a housing defining a cavity for receiving a source of electrical power therein; and a head connected to the housing and including heat dissipater 200, 200', 200", 200''' and the heat generating element; and may further comprise: a pivot connector for connecting heat dissipater 200, 200', 200", 200''' to the housing, wherein the head and housing are in a lantern-like configuration; or a thermal interface 250, 250' for connecting heat dissipater 200, 200', 200", 200''' to the housing, wherein the head and housing are in a flashlight-like configuration; or an articulated connection connecting heat dissipater 200, 200', 200", 200''' to the housing, wherein the head and housing are in an area light-like configuration.

As used herein, the term "about" means that dimensions, sizes, formulations, parameters, shapes and other quantities and characteristics are not and need not be exact, but may be approximate and/or larger or smaller, as desired, reflecting tolerances, conversion factors, rounding off, measurement error and the like, and other factors known to those of skill in the art. In general, a dimension, size, formulation, parameter, shape or other quantity or characteristic is "about" or "approximate" whether or not expressly stated to be such. It is noted that embodiments of very different sizes, shapes and dimensions may employ the described arrangements.

Although terms such as "up," "down," "left," "right," "front," "rear," "side," "top," "bottom," "forward," "backward," "under" and/or "over," may be used herein as a convenience in describing one or more embodiments and/or uses of the present arrangement, the articles described may be positioned in any desired orientation and/or may be utilized in any desired position and/or orientation. Such terms of position and/or orientation should be understood as being for convenience only, and not as limiting of the invention as claimed.

Further, what is stated as being "optimum" or "deemed optimum" may or not be a true optimum condition, but is the condition deemed to be "optimum" by virtue of its being selected in accordance with the decision rules and/or criteria defined by the applicable controlling function, e.g., for operating an LED at or near a predetermined temperature at which is operates efficiently or most efficiently.

While the present invention has been described in terms of the foregoing example embodiments, variations within the scope and spirit of the present invention as defined by the claims following will be apparent to those skilled in the art. For example, while heat sink 210 is shown has having slots 211S in certain sections of cylindrical wall 211, such slots may be provided in additional and/or other sections of wall 211 and/or of wall 213, as may be deemed appropriate for obtaining a desired air flow and thermal characteristics.

Further, openings in cylindrical walls 213, 211 may be made by drilling or boring radially inwardly through wall 213 and then through wall 211. Still further, while slots 211S are shown as being in segments of cylindrical wall 211 between adjacent radial wall segments 212, slots or openings may be made at or proximate to where a radial wall 212, 214 joins to a cylindrical wall 211, 213, thereby to form a fluid passage between one chamber and two adjacent chambers or between two chambers and two adjacent chambers.

While the preferred direction of flow of cooling fluid, e.g., air, through the passages of heat sink 210, 210', 210", 210'" is through fan 220, 220'" into the cavity inside wall 211, 1211 and therefrom radially outward and axially out of heat sink 210, 210', 210", 210'", the cooling fluid may be caused to flow in the opposite direction if desired.

Heat dissipater 100, 100', 100", 100'" may be connected to housing 20, 20' by different means than illustrated above, such as by a threaded engagement wherein both the heat dissipater and the housing have threads thereon arranged for engaging each other, or in a bayonet base configuration wherein one has plural radial pins that slip into "L-shaped" slots of the other similar to a bayonet base lamp. For example, one of circular walls 211, 13, 215 of heat dissipater 200, 200' could be extended higher than the others and have threads thereon that engage corresponding threads on housing 20, 20'.

In addition, the shape and/or location of reflector 110, including center lens 112 and small lenses 116, may be in a desired manner, e.g., for providing a spot or a flood of light, or something in between, and the location thereof may be adjustable relative to LEDs 242, 246 so as to provide adjustment of the shaping of the produced light beam, in any of the lights described.

While the heat dissipater is described herein in the context of a portable light, it should be understood that the heat-generating component or components 242, 246 from which heat is transferred to heat sink 210, 210', 210", 210'" may be an LED, but may also be any other heat generating component or element. Further, heat dissipater 200, 200', 200", 200'" may be connected to a housing in a lantern-like configuration, in a flashlight-like configuration, or in an area light-like configuration, or in another configuration, as may be desired.

While the example portable lights or devices 10, 10', 10", 10'" described herein may employ a battery or other energy source, e.g., a fuel cell, a photovoltaic (solar cell) source, and the like, light or device 10, 10', 10", 10'" may also be connected to an external source of power, e.g., by electrical wires. The external electrical source may be of any type or kind.

Each of the U.S. Provisional Applications, U.S. patent applications, U.S. patent Publications and/or U.S. patents identified herein are hereby incorporated herein by reference in their entirety.

Finally, numerical values stated are typical or example values, are not limiting values, and do not preclude substantially larger and/or substantially smaller values. Values in any given embodiment may be substantially larger and/or may be substantially smaller than the example or typical values stated.

What is claimed is:

1. A portable light heat dissipater comprising:

a heat sink having a cylindrical wall wherein a portion of the cylindrical wall defines a base, the base having first and second opposing sides, the first side being on the exterior of the cylindrical wall for having a light source thermally coupled thereto, and the second side of the base and the interior of the cylindrical wall having a plurality of walls extending inwardly therefrom interior the cylindrical wall for defining a plurality of interior axial fluid passages therethrough;

an elongated hollow tubular member defining a fluid passage therethrough;

a pivotable joint supporting said heat sink at a first end of the elongated hollow tubular member, whereby said heat sink is pivotable to different orientations relative to said elongated hollow tubular member;

a flexible sheath between the first end of said elongated hollow tubular member and said heat sink for defining a fluid passage between the fluid passage of said elongated hollow tubular member and the plurality of interior axial fluid passages of said heat sink;

a fluid mover disposed in the fluid passage of said elongated hollow tubular member near an end thereof remote from said heat sink for selectively causing a fluid to move through the fluid passages of said elongated hollow tubular member and said flexible sheath and through the plurality of interior axial fluid passages defined by the walls of said heat sink; and a light source disposed adjacent to and thermally coupled to the first side of the base of said heat sink, whereby said light source is cooled by fluid moved by said fluid mover through the fluid passage defined by said elongated hollow tubular member, the fluid passage defined by said flexible sheath and the interior axial fluid passages defined by said heat sink.

2. The portable light heat dissipater of claim 1 further comprising:

an electronic circuit coupled to said heat sink for controlling electrical power applied to said light source; or an electronic circuit coupled to said heat sink for controlling operation of said fluid mover; or an electronic circuit coupled to said heat sink for controlling electrical power applied to said light source and operation of said fluid mover.

3. The portable light heat dissipater of claim 2 wherein said electronic circuit controls electrical power applied to said light source or controls operation of said fluid mover or controls both responsive to the temperature of said light source.

4. The portable light heat dissipater of claim 2 wherein the electronic circuit is disposed on a circuit board defining a periphery of a given shape and size, and wherein said heat sink has a recess in the first side thereof, the recess having a shape and size corresponding to the given shape and size of the periphery of said circuit board, and wherein said circuit board is disposed in the recess.

5. The portable light heat dissipater of claim 1 wherein said heat sink includes at least one heat pipe coupling the first side of the base thereof and at least one of the plurality of walls of the second side of the base thereof.

6. The portable light heat dissipater of claim 1 wherein said light source comprises:

a high power light emitting diode; or an array of light emitting diodes; or a high power light emitting diode and an array of light emitting diodes.

7. The portable light heat dissipater of claim 1 wherein said fluid mover includes a fan for moving air.

8. The portable light heat dissipater of claim 1 further comprising:

a cover adjacent said heat sink and having openings therethrough through which the fluid moved by said fluid mover moves; or a cover adjacent said heat sink and having vents through which the fluid moved by said fluid mover moves, wherein the vents are downward facing when said heat sink is at an upward end of said elongated hollow tubular member.

9. The portable light heat dissipater of claim 1 wherein said movable joint includes an articulated joint providing at least two degrees of freedom of movement.

10. The portable light heat dissipater of claim 1 further comprising:

a source of electrical power at the end of said hollow tubular member proximate said fluid mover.

11. A portable heat dissipater comprising:

a heat sink having a cylindrical wall wherein a portion of the cylindrical wall defines a base, the base having first and second opposing sides, the first side being on the exterior of the cylindrical wall for having a heat generating element thermally coupled thereto, and the second side of the base and the interior of the cylindrical wall having a plurality of walls extending inwardly therefrom interior the cylindrical wall for defining a plurality of interior axial fluid passages therethrough;

an elongated hollow tubular member defining a fluid passage therethrough;

a pivotable joint supporting said heat sink at a first end of the elongated hollow tubular member, whereby said heat sink is pivotable to different orientations relative to said elongated hollow tubular member;

a flexible sheath between the first end of said elongated hollow tubular member and said heat sink for defining a fluid passage between the fluid passage of said elongated hollow tubular member and the plurality of interior axial fluid passages of said heat sink;

a fluid mover disposed in the fluid passage of said elongated hollow tubular member near an end thereof remote from said heat sink for selectively causing a fluid to move through the fluid passages of said elongated hollow tubular member and said flexible sheath and through the plurality of interior axial fluid passages defined by the walls of said heat sink; and a heat generating element disposed adjacent to and thermally coupled to the first side of the base of said heat sink, whereby said heat generating element is cooled by fluid moved by said fluid mover through the fluid passage defined by said elongated hollow tubular member, the fluid passage defined by said flexible sheath and the interior axial fluid passages defined by said heat sink.

12. The portable heat dissipater of claim 11 further comprising:

an electronic circuit proximate said heat sink for controlling electrical power applied to said heat generating element; or an electronic circuit proximate said heat sink for controlling operation of said fluid mover; or an electronic circuit proximate said heat sink for controlling electrical power applied to said heat generating element and operation of said fluid mover.

13. The portable heat dissipater of claim 12 wherein said electronic circuit controls electrical power applied to said heat generating element or controls operation of said fluid mover or controls both responsive to the temperature of said heat generating element.

14. The portable heat dissipater of claim 12 wherein the electronic circuit is disposed on a circuit board defining a periphery of a given shape and size, and wherein said heat sink has a recess in the first side thereof, the recess having a shape and size corresponding to the given shape and size of the periphery of said circuit board, and wherein said circuit board is disposed in the recess.

15. The portable heat dissipater of claim 11 wherein said heat sink includes at least one heat pipe coupling the first side of the base thereof and at least one of the plurality of walls on the second side of the base thereof.

16. The portable heat dissipater of claim 11 wherein said heat generating element includes:

at least one light emitting diode; or a high power light emitting diode; or an array of light emitting diodes; or a high power light emitting diode and an array of light emitting diodes.

17. The portable heat dissipater of claim 11 wherein said fluid mover includes a fan for moving air.

18. The portable heat dissipater of claim 11 further comprising:

a cover adjacent said heat sink and having openings therethrough through which the fluid moved by said fluid mover moves; or a cover adjacent said heat sink and having vents through which the fluid moved by said fluid mover moves, wherein the vents are downward facing when said heat sink is at an upward end of said elongated hollow tubular member.

19. The portable heat dissipater of claim 11 wherein said movable joint includes an articulated joint providing at least two degrees of freedom of movement.

20. The portable heat dissipater of claim 11 further comprising:

a source of electrical power at the end of said hollow tubular member proximate said fluid mover.

* * * * *